US007402227B2

(12) United States Patent
Yoshioka et al.

(10) Patent No.: US 7,402,227 B2
(45) Date of Patent: Jul. 22, 2008

(54) PLATING APPARATUS AND METHOD

(75) Inventors: Junichiro Yoshioka, Tokyo (JP); Nobutoshi Saito, Tokyo (JP); Yoshitaka Mukaiyama, Tokyo (JP); Tsuyoshi Tokuoka, Tokyo (JP)

(73) Assignee: Ebara Corporation, Tokyo (JP)

( * ) Notice: Subject to any disclaimer, the term of this patent is extended or adjusted under 35 U.S.C. 154(b) by 516 days.

(21) Appl. No.: 10/968,183

(22) Filed: Oct. 20, 2004

(65) Prior Publication Data

US 2005/0082163 A1 Apr. 21, 2005

Related U.S. Application Data

(62) Division of application No. 09/809,295, filed on Mar. 16, 2001, now abandoned.

(30) Foreign Application Priority Data

Mar. 17, 2000 (JP) ..... 2000-077188
Sep. 21, 2000 (JP) ..... 2000-287324

(51) Int. Cl.
*C25D 17/00* (2006.01)
*B23H 7/26* (2006.01)

(52) U.S. Cl. ..... 204/275.1; 204/198; 204/297.01

(58) Field of Classification Search ..... 204/198, 204/199, 225, 275.1, 297.01
See application file for complete search history.

(56) References Cited

U.S. PATENT DOCUMENTS 2,341,712 A * 2/1944 Gray ..... 205/138
3,623,962 A 11/1971 Beale
5,092,975 A * 3/1992 Yamamura et al. ..... 204/198
5,312,532 A * 5/1994 Andricacos et al. ..... 204/229.4
5,316,642 A * 5/1994 Young et al. ..... 204/198
5,421,987 A * 6/1995 Tzanavaras et al. ..... 205/133
5,516,412 A * 5/1996 Andricacos et al. ..... 204/224 R
6,074,544 A * 6/2000 Reid et al. ..... 205/157
6,099,702 A * 8/2000 Reid et al. ..... 204/212
6,113,764 A * 9/2000 Emch ..... 204/509
6,113,769 A 9/2000 Uzoh et al.
6,174,123 B1 * 1/2001 Marttila ..... 414/626

(Continued)

FOREIGN PATENT DOCUMENTS

JP 64-10073 1/1989

(Continued)

*Primary Examiner*—Nam X Nguyen
*Assistant Examiner*—Luan V Van
(74) *Attorney, Agent, or Firm*—Wenderoth, Lind & Ponack, L.L.P.

(57) ABSTRACT

An apparatus forms a plated film in fine trenches and plugs for interconnects and in the openings of a resist formed in the surface of a substrate such as a semiconductor wafer, and forms bumps (protruding electrodes) on the surface of a semiconductor wafer. The apparatus includes a substrate holder capable of opening and closing for holding a substrate such that the front surface of the substrate is exposed while the backside and the edge thereof are hermetically sealed. A plating tank accommodates a plating liquid in which an anode is immersed. A diaphragm is provided in the plating tank and disposed between the anode and the substrate held by the substrate holder. Plating liquid circulating systems circulate the plating liquid to respective regions of the plating tank, separated by the diaphragm. A deaerating unit is disposed in at least one of the plating liquid circulating systems.

30 Claims, 32 Drawing Sheets

U.S. PATENT DOCUMENTS

| | | | | |
|---|---|---|---|---|
| 6,203,582 | B1 * | 3/2001 | Berner et al. | 29/25.01 |
| 6,248,222 | B1 * | 6/2001 | Wang | 204/297.09 |
| 6,258,220 | B1 * | 7/2001 | Dordi et al. | 204/198 |
| 6,258,244 | B1 * | 7/2001 | Ohmi et al. | 205/333 |
| 6,309,524 | B1 | 10/2001 | Woodruff et al. | |
| 6,391,209 | B1 | 5/2002 | Belongia et al. | |
| 6,454,918 | B1 | 9/2002 | Sakaki | |
| 6,517,689 | B1 * | 2/2003 | Hongo et al. | 204/228.7 |

FOREIGN PATENT DOCUMENTS

| | | |
|---|---|---|
| JP | 1-116094 | 5/1989 |
| JP | 5-206348 | 8/1993 |
| JP | 6-334087 | 12/1994 |
| JP | 8-134699 | 5/1996 |
| JP | 10-287978 | 10/1998 |
| JP | 11-152597 | 6/1999 |

* cited by examiner

PLATING APPARATUS AND METHOD

This is a Divisional Application of U.S. patent application Ser. No. 09/809,295, filed Mar. 16, 2001 now abandoned.

BACKGROUND OF THE INVENTION

1. Field of the Invention

The present invention relates to an apparatus and method for plating the processing surface, to be plated, of a substrate, and more particularly to a plating apparatus and method suited for forming a plated film in fine trenches and plugs for interconnects, and in the openings of a resist formed in the surface of a substrate such as a semiconductor wafer, and for forming bumps (protruding electrodes) on the surface of a semiconductor wafer for electrically connecting semiconductor chips and the substrate.

2. Description of the Related Art

FIG. 30 shows the general construction of a conventional plating apparatus for plating copper or the like on a semiconductor substrate. As shown in FIG. 30, the conventional substrate plating apparatus is provided with a plating tank 411 that holds a plating liquid Q, and arranges a substrate W, such as a semiconductor wafer, and an anode 412 opposing each other therein. A plating power source 413 is connected to the substrate W and the anode 412. When the plating power source 413 applies a prescribed voltage thereacross, a current containing ions dissolved from the copper plate or the like serving as the anode 412 flows toward the surface (processing surface to be plated) of the substrate W and forms a plated copper film thereon. The substrate W is detachably held by a substrate holder 414. When the current flows between the anode 412, which is formed of copper containing phosphorus, for example, and the substrate W, the ionized copper is conveyed by the plating current and deposited on the surface of the substrate W to form a plated film. The plating liquid Q overflowing the wall 415 of the plating tank 411 is collected in a recovery tank 416. The plating liquid Q in the recovery tank 416 is reintroduced to the plating tank 411 through a plating liquid circulation system comprising a pump 420, a temperature regulating tank 421, a filter 422, a flow meter 423 and so on.

When forming a plated film in fine trenches and plugs for interconnects, or in openings of a resist having poor wettability formed in a substrate, such as a semiconductor water, a plating liquid or a pretreatment liquid cannot enter deep inside of the trenches, plugs and openings, thereby leaving air bubbles therein. Such air bubbles can cause plating defects or incomplete plating.

In order to prevent such plating defects or incomplete plating, conventionally the surface tension of a plating liquid has been lowered by adding a surfactant thereto, thereby facilitating entering of the plating liquid into the fine trenches and plugs for interconnects of the substrate to be plated, or the openings of a resist. However, air bubbles tend to generate more easily in a plating liquid during circulation when the surface tension of the plating liquid is low. Further, the addition of a surfactant to the plating liquid can cause an abnormal plating deposition and increase the amount of an organic substance taken in the plated film, leading to lowering of the properties of the plated film.

In a tape automated bonding (TAB) or flip chip, for example, it has been widely conducted to deposit gold, copper, solder, nickel or multi-layered materials thereof at prescribed areas (electrodes) on the surface of a semiconductor chip having interconnects, thereby forming protruding connecting electrodes (bumps). Such bumps electrically connect the semiconductor chip with substrate electrodes or TAB electrodes. There are various methods for forming these bumps, including an electrolytic plating method, vapor deposition method, printing method, and ball bump method. The electrolytic plating method has become wide in use due to its relatively stable performance and capability of forming fine connections, in view of the recent tendency toward increasing the number of I/O terminals on semiconductor chips and toward finer pitch.

The electrolytic plating method includes a spurting or cup method in which a substrate such as a semiconductor wafer is positioned horizontally with the processing surface to be plated facedown and a plating liquid is spurted from below and a dipping method in which the substrate is placed vertically in a plating tank and immersed in a plating liquid, while a plating liquid is supplied from the bottom of the plating tank and is allowed to overflow the tank. According to the dipping method of electrolytic plating, bubbles that can adversely affect the quality of the plating are easily removed and the footprint is small. Further, the dipping method can be readily adapted to variations in wafer size. The dipping method is therefore considered to be suited for bump plating in which holes to be filled by the plating are relatively large and which requires a fairly long plating time.

When forming bumps at prescribed areas of a substrate having interconnects, a seed layer 500 as an electric feed layer is first formed on the surface of the substrate W, as shown in FIG. 29A. A resist 502 having a height H of e.g. 20-120 μm is applied to the entire surface of the seed layer 500. An opening 502*a* having a diameter D of e.g. 20-200 μm is formed in a prescribed portion of the resist 502. Plating is performed onto such a surface of the substrate W to deposit and grow a plated film 504 in the opening 502*a*, thereby forming a bump 506 (see FIGS. 29B-29E). When using the facedown-type electrolytic plating to form the bump 506, air bubbles 508 generated in the plating liquid are likely to remain in on the inside of the opening 502*a*, as shown by the dotted line in FIG. 29A, particularly when the resist 502 is hydrophobic.

When using the dipping-type electrolytic plating apparatus to form the bump, on the other hand, the air bubbles can escape easily. Conventional electrolytic plating apparatuses for the dipping method employ a substrate holder which holds a substrate sealing the edge and the backside thereof, such as a semiconductor wafer, while exposing the front surface (processing surface to be plated). Since such a substrate holder is immersed in the plating liquid with the substrate when plating the surface of the substrate, it is difficult to automate the entire plating process from loading of the substrate to unloading of the substrate after plating. Further, the plating apparatus occupies a considerably large space.

SUMMARY OF THE INVENTION

The present invention has been made in view of the above drawbacks in the related art. It is therefore a first object of the present invention to provide a plating apparatus and method which enables a plating liquid entering into fine trenches and plugs for wiring and into openings of a resist formed in a substrate, without adding a surfactant to the plating liquid, and without suffering from plating defects and incomplete plating.

It is a second object of the present invention to provide a plating apparatus which employs the dipping method in which air bubbles can escape relatively easily, and is capable of automatically forming a plated metal film suitable for protruding connecting electrodes such as bumps, and which does not occupy a large space.

A first embodiment of a plating apparatus according to the present invention comprises a substrate holder capable of opening and closing for holding a substrate such that the front surface of the substrate is exposed while the back side and the edge thereof are hermetically sealed. A plating tank holds a plating liquid in which an anode is immersed. A diaphragm is provided in the plating tank and disposed between the anode and the substrate held by the substrate holder. Plating liquid circulating systems circulate the plating liquid through respective regions of the plating tanks, partitioned by the diaphragm. A deaerating unit is provided in at least one of the plating liquid circulating systems.

Described above, the diaphragm, such as an ion exchange membrane or a neutral porous diaphragm, is disposed between the substrate and the anode, thereby preventing particles generated on the anode side from flowing through the diaphragm to the substrate side.

Further, at least one of the plating liquid circulating systems for circulating a plating liquid through the regions in the plating tank partitioned by the diaphragm is provided with a deaerating unit for removing gas from the plating liquid during the plating process. Accordingly, it is possible to maintain a low concentration of dissolved gases in the plating liquid, thereby reducing generation of gas bubbles in the plating liquid that can cause plating defects.

The plating apparatus preferably further comprises a monitoring unit disposed downstream of the deaerating unit for monitoring the concentration of dissolved oxygen in the plating liquid. With this construction, the plating liquid circulating system is provided with a unit for measuring and controlling dissolved gases. Accordingly, it is possible to maintain a uniform concentration of dissolved gas in the plating liquid so as to achieve a constant and stable high-quality plating process.

The deaerating unit preferably comprises at least a deaerating membrane and a vacuum pump, the pressure on the decompressed side of the deaerating unit being controlled. With this construction, it is possible to easily remove dissolved gases from the plating liquid.

A plating method according to the present invention comprises providing a diaphragm between a substrate and an anode immersed in a plating liquid held in a plating tank, circulating the plating liquid in each region of the plating tank partitioned by the diaphragm, and plating the substrate while maintaining the concentration of dissolved oxygen in the plating liquid between 1 μg/l (1 ppb) and 4 mg/l (4 ppm) by a deaerating unit.

A second embodiment of a plating apparatus according to the present invention comprises a cassette table for loading a cassette housing a substrate therein. A substrate holder is capable of opening and closing for holding the substrate such that the front surface of the substrate is exposed while the back side and the edge thereof are hermetically sealed. A substrate loading/unloading unit supports the substrate holder, and loads and unloads the substrate. A substrate transferring device transfers the substrate between the cassette table and the substrate loading/unloading unit. A plating tank accommodates the substrate holder and the substrate, held vertically and facing toward an anode, and plates the surface of the substrate by injecting a plating liquid from the bottom thereof. A substrate holder transferring device has a transporter that grips the substrate holder and is vertically moveable, and transfers the substrate holder between the substrate loading/unloading unit and the plating tank.

By starting the plating apparatus after loading the cassette housing substrates on the cassette table, it is possible to fully automate the electrolytic plating process employing the dipping method. Accordingly, it is possible to automate the formation of a plated metal film on the surface of a substrate suitable for bump electrodes and the like.

The plating tank may comprise a plurality of plating units accommodated in an overflow tank that accommodate electrodes for dummy plating, each unit being adapted for accommodating and plating one substrate. With this configuration, the overflow tank serves as a plating tank, thereby eliminating uneven plating between the plating units. This configuration also increases the surface of the electrodes for dummy plating, thereby improving efficiency of the dummy plating process. Further, since most of the plating liquid is circulated through the dummy electrolytic section, it is possible to facilitate formation of a uniform plating liquid state.

Each plating unit is preferably provided with a paddle that is disposed between the anode and the substrate, and reciprocates to agitate the plating liquid. With this construction, the paddle generates a uniform flow of plating liquid across the entire surface of the substrate, thereby enabling formation of a plated film having a uniform thickness over the entire surface of the substrate.

A paddle drive device for driving the paddles is preferably provided on the opposite side of the substrate holder transferring device with respect to the plating tank. With this construction, it is possible to facilitate maintenance of the substrate holder transferring device and the paddle drive device.

The plating apparatus may comprise plating tanks for performing different types of plating, wherein each plating tank comprises an overflow tank and plating units for performing each type of plating, the plating units being accommodated in the overflow tank. With this construction, it is possible to form multi-layer bumps comprising copper-nickel-solder, for example, in a continuous process.

A local exhaust duct may be provided along one side of the plating tank. With this construction, an air flow is generated in a single direction toward the local exhaust duct. Accordingly, a vapor emitted from the plating tanks can be carried on this air flow, thereby preventing the vapor from contaminating the semiconductor wafers and the like.

A stocker for storing the substrate holder in a vertical position may be provided between the substrate loading/unloading unit and the plating tank; and the substrate holder transferring device may have first and second transporters. By performing transferring operations with separate transporters, the substrate holder can be transferred more smoothly, thereby increasing throughput.

The substrate loading/unloading unit may preferably be provided with a sensor for checking the contact state between the substrate and contact points when the substrate is loaded into the substrate holder. The second transporter selectively transfers only such substrate that has a good contact with the contact points to a subsequent process. With this construction, the plating operation need not be halted, but is allowed to continue, if a poor contact is detected between the substrate and contact points when the substrate is loaded into the substrate holder. The substrate in which the poor contact is detected is not applied to the plating process, but instead is discharged from the cassette after being returned thereto.

The substrate holder transferring device may employ a linear motor as a means for moving the transporter. With this construction, the transporter can be moved over a long distance and the overall length of the apparatus can be reduced. Further, parts such as long ball screws that require high-precision and maintenance can be eliminated.

The plating apparatus may further comprises a pre-wetting tank, blowing tank, and cleaning tank between the stocker and the plating tank. With this construction, it is possible to perform a series of processes in the same apparatus, such as immersing the substrate in pure water held in the pre-wetting tank to wet the surface of the substrate and improve its hydrophilic properties, performing the plating operation, thereafter cleaning the substrate in pure water in the cleaning tank, and drying the substrate in the blowing tank. When performing a plating process using solder, copper or other metals that can be oxidized to form an oxide film, the substrate should be placed in a pre-soaking tank after the pre-wetting tank, wherein the oxide film on the seed layer is removed through chemical etching before performing the plating operation.

The substrate loading/unloading unit may be constructed to support two substrate holders side by side that are slidable laterally. With this construction, the apparatus requires only one mechanism for opening and closing the substrate holder and avoids the need to move the substrate transferring device laterally.

A first embodiment of a plating apparatus for forming a protruding electrode according to the present invention concerns an apparatus for forming a protruding electrode on a substrate having wiring formed thereon, comprising a cassette table for loading a cassette housing the substrate therein. A plating tank plates the substrate. A cleaning unit cleans the plated substrate. A drying unit dries the cleaned substrate. A deaerating unit deaerates a plating liquid in the plating tank. A plating liquid regulating unit analyzes the components of the plating liquid and adds components to the plating liquid based on the results of the analysis. A substrate transferring device transfers the substrate.

A second embodiment of a plating apparatus for forming a protruding electrode according to the present invention concerns an apparatus for forming a protruding electrode on a substrate having wiring formed thereon, comprising a cassette table for loading a cassette housing the substrate therein. A pre-wetting tank applies a pre-wetting treatment to the substrate to increase the wettability thereof. A plating tank plates the substrate after the pre-wetting treatment. A cleaning unit cleans the plated substrate. A drying unit dries the cleaned substrate. A deaerating unit deaerates a plating liquid in the plating tank and a substrate transferring device transfers the substrate.

A third embodiment of a plating apparatus for forming a protruding electrode according to the present invention concerns an apparatus for forming a protruding electrode on a substrate having wiring formed thereon, comprising a cassette table for loading a cassette housing the substrate therein. A pre-soaking tank applies a pre-soaking treatment to the substrate. A plating tank plates the substrate after the pre-soaking treatment. A cleaning unit cleans the plated substrate. A drying unit dries the cleaned substrates. A deaerating unit deaerates the plating liquid in the plating tank and a substrate transferring device transfers the substrates.

A fourth embodiment of a plating apparatus for forming a protruding electrode according to the present invention concerns an apparatus for forming a protruding electrode on a substrate by plating the substrate with at least two kinds of metals, comprising a plurality of plating tanks each for plating the substrate with each of the above metals. A substrate transferring device transfers the substrate, wherein the plating tanks are disposed along a transferring path of the substrate transferring device.

A fifth embodiment of a plating apparatus for forming a protruding electrode according to the present invention concerns an apparatus for forming a protruding electrode on a substrate having wiring formed thereon, comprising a cassette table for loading a substrate cassette thereon. A plating tank plates the substrate. A cleaning unit cleans the plated substrate. A drying unit dries the cleaned substrate. A deaerating unit deaerates a plating liquid in the plating tank. An annealing unit anneals the plated substrate and a substrate transferring device transfers the substrate.

A first embodiment of a plating method for forming protruding electrodes according to the present invention concerns a method for forming a protruding electrode on a substrate having wiring formed thereon, comprising holding a substrate taken out of a cassette by a substrate holder, pre-wetting the substrate held by the substrate holder, plating the pre-wetted surface of the substrate by immersing the substrate together with the substrate holder in a plating liquid cleaning and drying the plated substrate together with the substrate holder, and taking the substrate out of the substrate holder and drying the substrate.

A second embodiment of a plating method for forming a protruding electrode according to the present invention concerns a method for forming a protruding electrode on a substrate having wiring formed thereon, comprising holding a substrate taken out of a cassette by a substrate holder, pre-soaking the substrate held by the substrate holder, plating the pre-soaked surface of the substrate by immersing the substrate together with the substrate holder in a plating liquid, cleaning and drying the substrate together with the substrate holder and taking the substrate out of the substrate holder and drying the substrate.

DETAILED DESCRIPTION OF THE PREFERRED EMBODIMENTS

Figure 1:
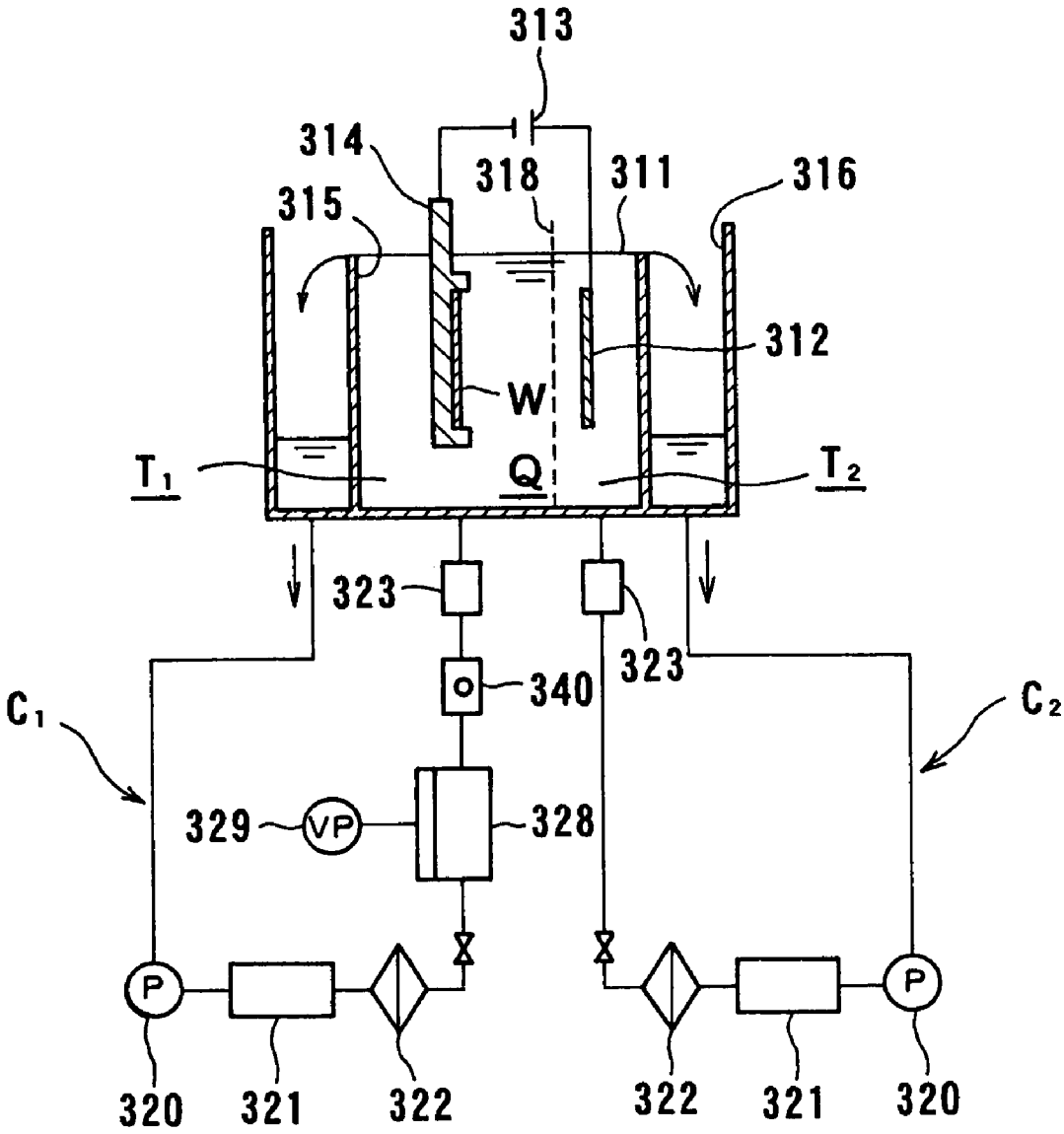
FIG. 1 is a schematic view of a plating apparatus according to a first embodiment of the present invention.

Preferred embodiments of a plating apparatus according to the present invention will be described with reference to FIGS. 1 through 28. FIG. 1 shows the construction of a plating apparatus according to a first embodiment of the present invention. As shown in FIG. 1, the plating apparatus includes a cation exchange membrane 318 as a diaphragm which is disposed between a cathode (substrate W) and an anode 312 connected to a plating power source 313. The cation exchange membrane (diaphragm) 318 partitions the space in the plating tank 311 into two regions, $T_1$ including the substrate W and $T_2$ including the anode 312. The plating apparatus of this embodiment is a copper-plating apparatus designed to form a plated copper film on the surface (processing surface to be plated) of the substrate W. The anode 312 is a soluble anode and a plating liquid Q is a copper sulfate solution. The substrate W, which is detachably held by the substrate holder 314 with a watertight seal being made over the backside of the substrate W, is immersed in the plating liquid Q.

The cation exchange membrane 318 only allows passage of Cu ions dissolved from the soluble anode 312, while blocking passage of impurities dissolved from the anode 312. This can minimize the amount of particles in the plating liquid Q in the substrate W side region $T_1$ partitioned by the cation exchange membrane 318.

This embodiment employs a cation exchange membrane 318 disposed between the substrate W and the anode 312. However, the same effects can be obtained by using a neutral porous diaphragm capable of removing small particles in place of the cation exchange membrane 318.

The cation exchange membrane 318, having the capability of selectively filtering ions according to their electrical energy, can be a commercial product. One such example of the cation exchange membrane 318 is "Selemion" manufactured by Asahi Glass Co., Ltd. The neutral porous diaphragm is a porous membrane formed of synthetic resin and having extremely small holes of uniform diameter. One such example is a product called "YUMICRON" manufactured by Yuasa Ionics Co., Ltd., which is composed of a polyester nonwoven fabric as a base material and of polyvinylidene fluoride and titanium oxide as a membrane material.

A first plating liquid circulation system $C_1$, which circulates the plating liquid Q which overflows the wall 315 of the plating tank 311 and collects in the recovery tank 316 back to the region $T_1$ on the substrate W side of the plating tank 311, is provided on the substrate W side of the plating tank 311. The first plating liquid circulation system $C_1$ includes a vacuum pump 320 that circulates the plating liquid Q through a temperature regulating unit 321, a filter 322, a deaerator (deaerating unit) 328, a dissolved oxygen concentration measuring unit 340, and a flow meter 323. The temperature regulating unit 321 stabilizes the growth rate of the plated film by maintaining the plating liquid Q at a prescribed temperature. The filter 322 removes particles from the plating liquid Q before the plating liquid Q is reintroduced into the plating tank 311.

The deaerator 328 removes dissolved gases from the plating liquid Q flowing through the first plating liquid circulation system $C_1$. The deaerator 328 is provided with a vacuum pump 329 for removing various dissolved gases, including oxygen, air, carbon dioxide and the like, from the plating liquid Q flowing through the circulation systems, using a membrane which allows only gases to pass therethrough, while preventing the passage of liquid. The vacuum pump 329 removes dissolved gases from the plating liquid by drawing the gases through the membrane in the deaerator 328. The dissolved oxygen concentration measuring unit 340 is provided in the first plating liquid circulation system $C_1$ to monitor the concentration of dissolved oxygen in the plating liquid circulating through the first plating liquid circulation system $C_1$. Based on the results of the measurements, it is possible to regulate the pressure on the decompressed side of the deaerator 328 using a control unit (not shown) for controlling the rotational speed of the vacuum pump 329 or the like. With this method, it is possible to regulate the dissolved gases in the plating liquid at a desired concentration. It is desirable to maintain the concentration of dissolved oxygen between approximately 1 μg/l (1 ppb) and 4 mg/l (4 ppm). With this concentration, it is possible to eliminate bubbles dissolved in the plating liquid nearly to zero, thereby forming a satisfactory plated film.

The flow meter 323 measures the flow of the plating liquid Q circulating through the first plating liquid circulation system $C_1$ and transmits a signal representing this flow to a control unit (not shown). The control unit maintains the amount of plating liquid Q circulating through the first plating liquid circulation system $C_1$ at a fixed prescribed amount by controlling the speed of the vacuum pump 320, for example, thereby achieving stable plating in the plating tank 311.

A second plating liquid circulation system $C_2$ is provided on the anode 312 side of the plating tank 311 partitioned by the cation exchange membrane 318. The second plating liquid circulation system $C_2$ circulates the plating liquid Q overflowing the plating tank 311 back to the region $T_2$ on the anode side of the plating tank 311 by the pump 320 through the temperature regulating unit 321, filter 322, and flow meter 323. The flow meter 323 measures the flow of the plating liquid Q circulating through the second plating liquid circulation system $C_2$ and transmits a signal representing this flow to a control unit (not shown). The control unit maintains the amount of plating liquid Q circulating through the second plating liquid circulation system $C_2$ at a fixed rate by controlling the speed of the vacuum pump 320 or the like.

Figure 2:
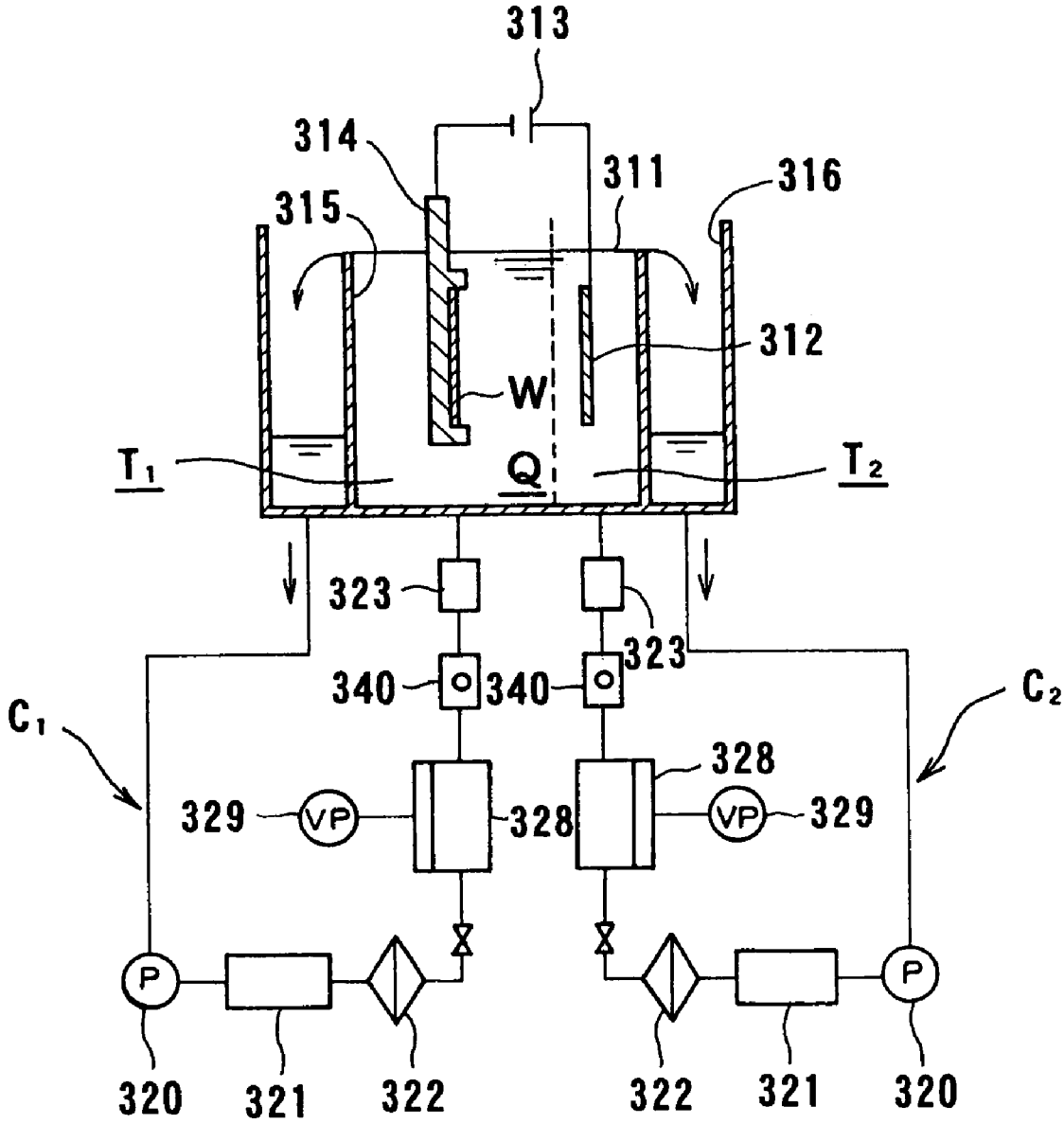
FIG. 2 is a schematic view of a plating apparatus according to a second embodiment of the present invention.

FIG. 2 shows a plating apparatus according to a second embodiment of the present invention. In this embodiment, the second plating liquid circulation system $C_2$ disposed on the anode 312 side of the plating tank 311 partitioned by the cation exchange membrane 318 is further provided with the deaerator (deaerating device) 328 and dissolved oxygen concentration measuring unit 340. Accordingly, the plating liquid Q is deaerated while being circulated to both the regions $T_1$ on the substrate W (anode) side and $T_2$ on the anode 312 side partitioned by the cation exchange membrane 318. Therefore, it is possible to further reduce the amount of gas bubbles in the plating liquid compared to the first embodiment shown in FIG. 1.

While not shown in the drawings, it is also possible to omit the deaerator 328 in the first plating liquid circulation system $C_1$ on the substrate W side, and only provide the deaerator 328 in the second plating liquid circulation system $C_2$ on the anode 312 side partitioned by the cation exchange membrane 318. This configuration can also supply the plating liquid with an extremely low amount of dissolved gases to the substrate W, since copper ions in the plating liquid are carried by the electrical current from the anode 312 side to the substrate W side.

By providing a deaerator 328 in the first plating liquid circulation system $C_1$ and/or second plating liquid circulation system $C_2$, as described above, air bubbles introduced into the plating liquid when the plating liquid Q overflows the plating tank 311 and collects in the recovery tank 316 are removed when passing through the deaerator 328. As a result, dissolved oxygen and other dissolved gases are removed from the plating liquid Q, thereby preventing a reaction in the plating liquid caused by the dissolved gases and achieving a stable plating environment capable of restraining side reactions and degradation of plating liquid.

The embodiments described above show copper plating on the surface of a semiconductor wafer. However, the object of the plating is not limited to semiconductor wafers. The present invention can also be applied to other types of substrates. Further, plating metal other than copper can be used in the anode. While the deaerator and dissolved oxygen concentration measuring unit are disposed in the circulating paths of the plating liquid in the embodiments described above, these units can also be disposed in the plating tank itself. In this way, many variations to the embodiments can be made without departing from the scope of the invention.

The plating apparatuses of the above embodiments can provide optimal plating conditions, due to the provision of a deaerator (deaerating unit) 328 in at least one of the circulation systems $C_1$ and $C_2$ partitioned by the cation exchange membrane (diaphragm) 318 for deaerating the plating liquid Q prior to the plating process or during the plating process. By preventing the generation of air bubbles on the anode and cathode sides, a plated film can be efficiently formed on the substrate W without defects caused by air bubbles.

The dissolved oxygen concentration measuring unit 340 provided in the circulation systems $C_1$ and $C_2$ for controlling dissolved gases in the plating liquid can reduce the amount of dissolved gases in the plating liquid in the plating tank. Accordingly, there is less chance for air bubbles to be attached on the surface of the substrate (processing surface to be plated), thereby achieving a stable plating process.

Figure 3A:
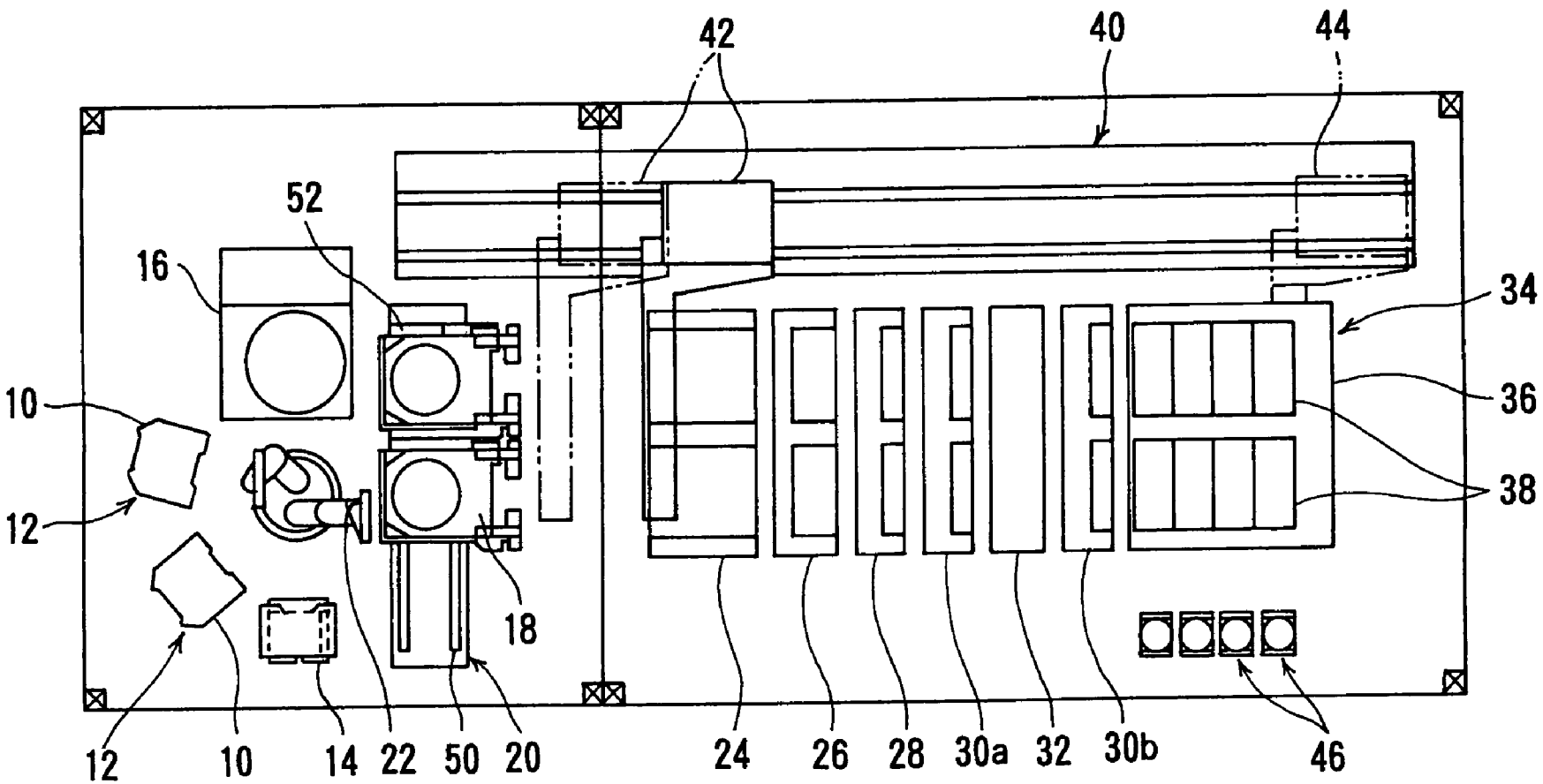
FIG. 3A is a plan view of the overall plating apparatus according to a third embodiment of the present invention.

FIG. 3A shows the overall construction of a plating apparatus according to a third embodiment of the present invention. As shown in FIG. 3A, the plating apparatus is provided with two cassette tables 12 for placing thereon cassettes 10 that house substrates W, such as semiconductor wafers; an aligner 14 for aligning the orientation flat or notch, etc. of the substrate W in a prescribed direction; and a spin dryer 16 for spin drying the substrate at a high rotation speed after the plating process, all arranged along the same circle. A substrate loading/unloading unit 20 for placing the substrate holders 18 thereon, which detachably hold the substrates, is provided along a tangent line to the circle. A substrate transferring device 22, such as a transferring robot, is disposed in the center of these units for transferring substrates W therebetween.

Figure 3B:
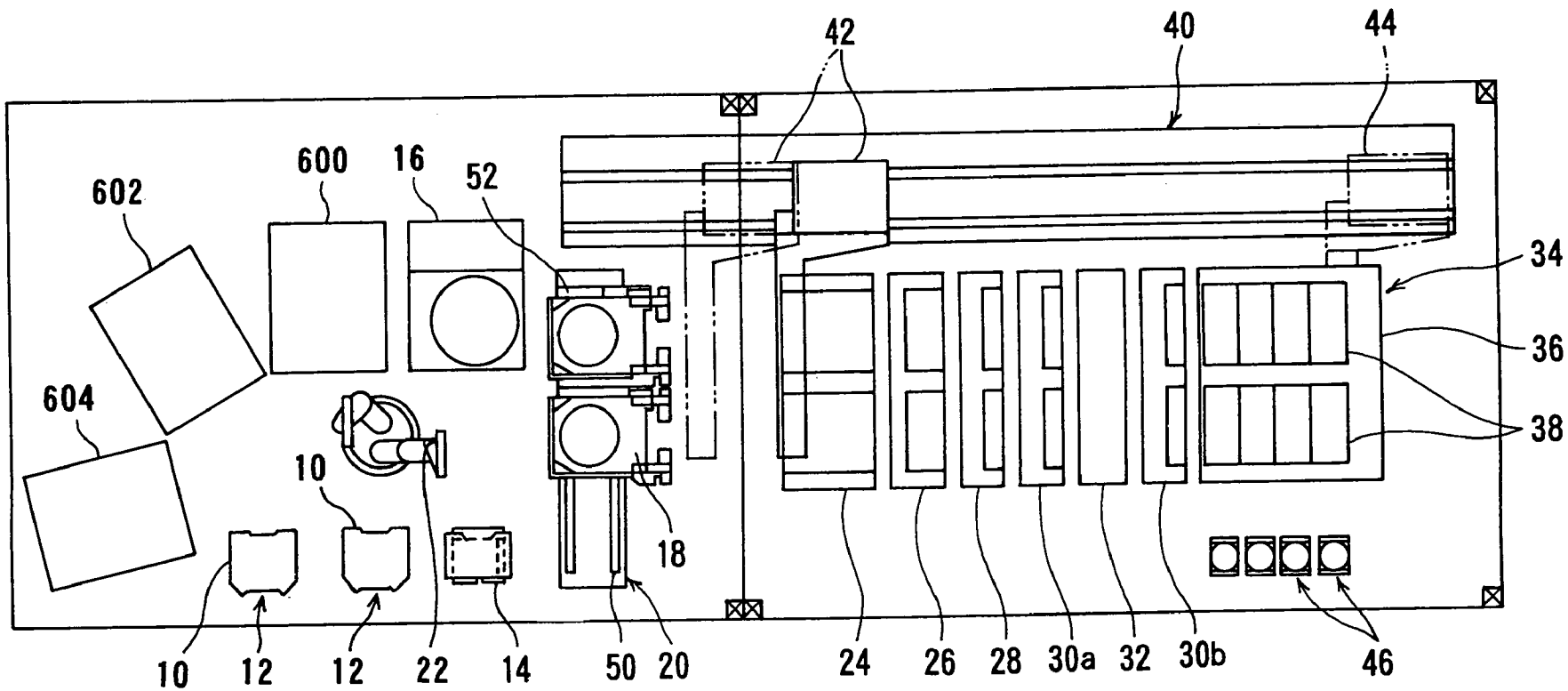
FIG. 3B is a plan view showing a variation of the apparatus of FIG. 3A.
Figure 3C:
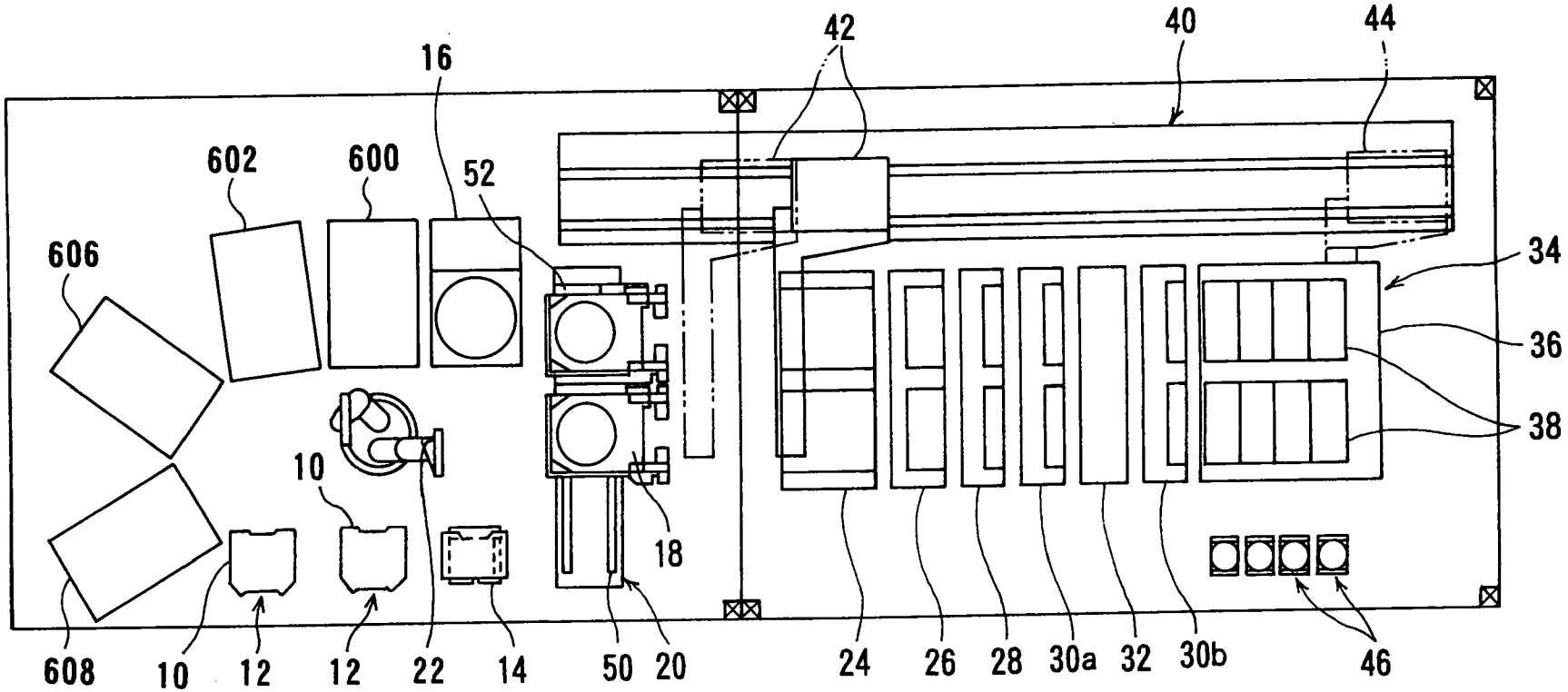
FIG. 3C is a plan view showing another variation of the apparatus of FIG. 3A.

As shown in FIG. 3B, it is also possible to provide, around the substrate transferring device 22, a resist peeling unit 600 for peeling the resist 502 (see FIGS. 29A-29E) off from the surface of the substrate; a seed layer removing unit 602 for removing the unneeded seed layer 500 (see FIGS. 29A-29E) after the plating process; a heating unit 604 for heating the plated substrate. Further, as shown in FIG. 3C, a reflowing unit 606 for causing a plated film 504 (see FIGS. 29B-29D) to reflow and an annealing unit 608 for annealing the substrate after reflowing may be provided in place of the heating unit 604.

Disposed in a line that proceeds away from the substrate loading/unloading unit 20 are in order a stocker 24 for keeping and temporarily placing the substrate holders 18; a pre-wetting tank 26 holding pure water in which the substrate W is immersed to make the surface of the substrate more hydrophilic; a pre-soaking tank 28 holding a sulfuric acid or hydrochloric acid solution or the like for etching the surface of the seed layer formed on the surface of the substrate W in order to remove the oxidized layer having a high electrical resistance; a first cleaning tank 30*a* holding pure water for cleaning the surface of the substrate; a blowing tank 32 for removing water from the substrate after the cleaning process; a second cleaning tank 30*b*; and a copper plating tank 34. The copper plating tank 34 includes an overflow tank 36 and a plurality of copper plating units 38 accommodated in the overflow tank 36. Each copper plating unit 38 accommodates one substrate W and performs a plating process on the substrate W. Although copper plating is described as an example in this embodiment, the same description naturally holds for nickel, solder, or gold plating.

A substrate holder transferring device (substrate transferring device) 40 is provided along the side of the units for transferring the substrate holders 18 with substrates W to each unit. The substrate holder transferring device 40 includes a first transporter 42 for transferring substrates W between the substrate loading/unloading unit 20 and stocker 24, and a second transporter 44 for transferring substrates W between the stocker 24, pre-wetting tank 26, pre-soaking tank 28, cleaning tanks 30*a* and 30*b*, blowing tank 32, and copper plating tank 34.

A plurality of paddle driving units 46 are disposed on the opposite side of the substrate holder transferring device 40 with respect to the overflow tank 36. The paddle driving units 46 drive paddles 202 (see FIGS. 20 and 21) positioned in each of the plating units 38 and serving as stirring rods for agitating the plating liquid.

The substrate loading/unloading unit 20 is provided with a flat shaped loading plate 52 capable of sliding horizontally along rails 50. The loading plate 52 supports two of substrate holders 18 side by side in a level state. After the substrate W is transferred between one of the substrate holders 18 and the substrate transferring device 22, the flat loading plate 52 is slid in a horizontal direction, and then the substrate W is transferred between the other substrate holder 18 and the substrate transferring device 22.

Figure 4:
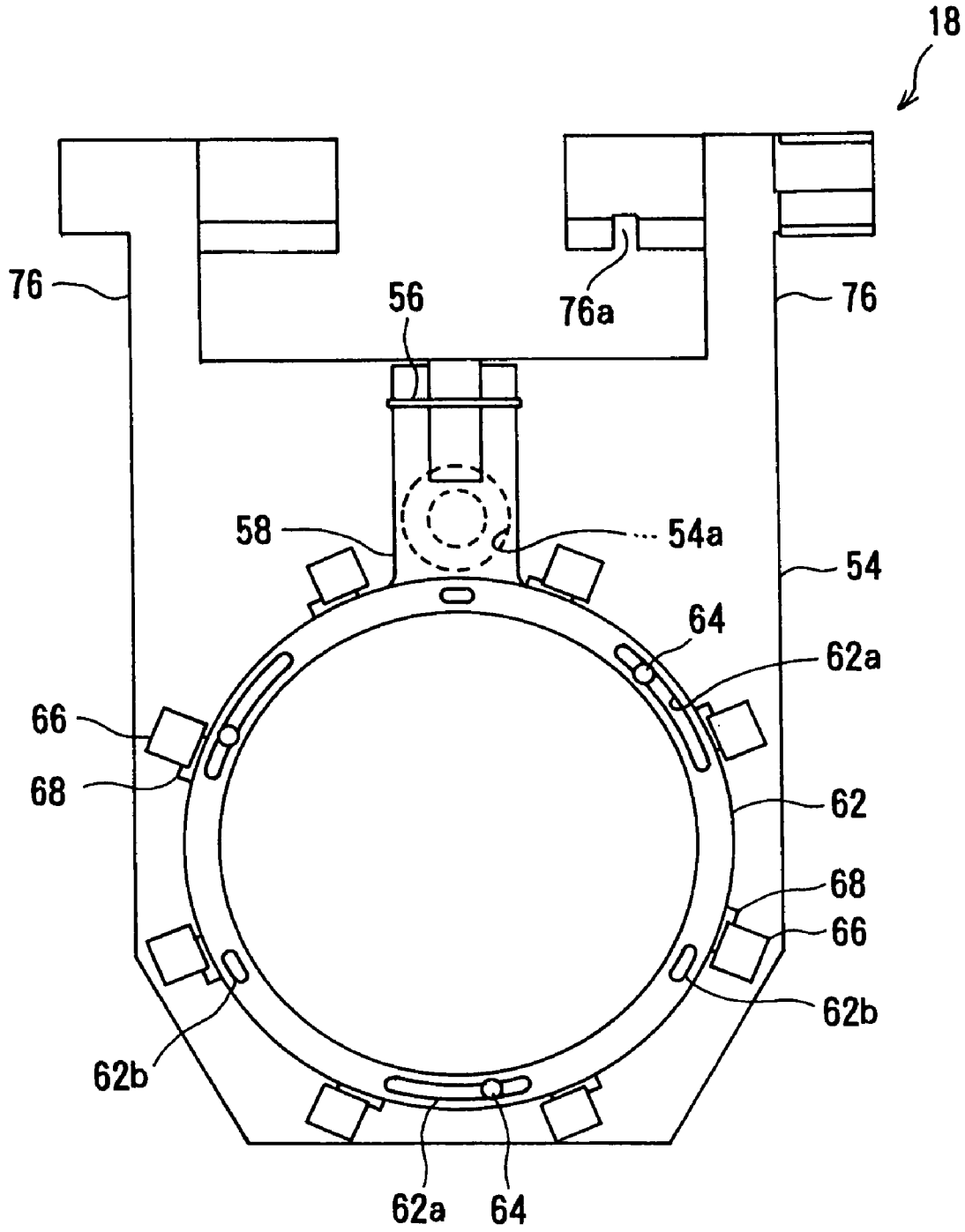
FIG. 4 is a plan view of a substrate holder.
Figure 5:
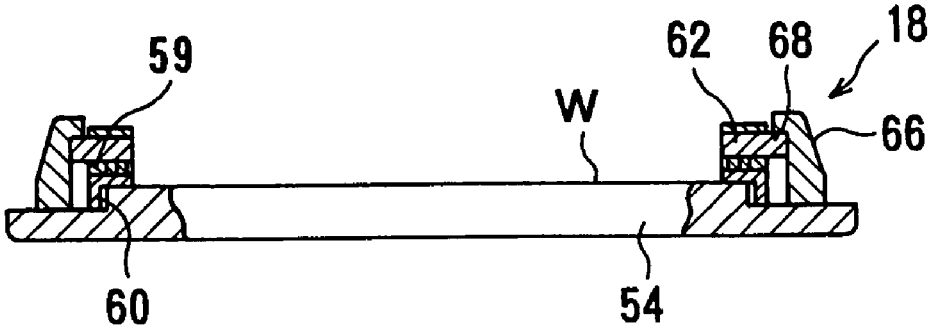
FIG. 5 is an enlarged cross-sectional view showing a substrate that is held and sealed in the substrate holder.
Figure 6:
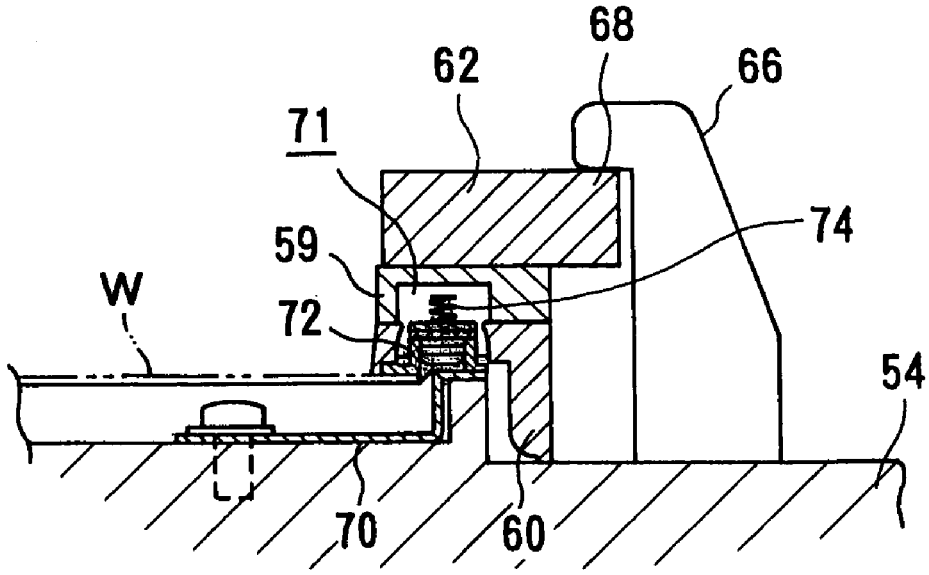
FIG. 6 is an enlarged cross-sectional view of a relevant portion of FIG. 5 in terms of a supply of electricity to the substrate.

As shown in FIGS. 4 through 6, the substrate holder 18 includes a flat, rectangular shaped fixed supporting member 54, and a ring-shaped moveable supporting member 58 mounted on the fixed supporting member 54 and capable of opening and closing over the fixed supporting member 54 through a hinge 56. A ring-like seal packing 60, having a rectangular cross-section with an open bottom with one of the parallel sides longer than the other, is mounted at the fixed supporting member 54 side of the moveable supporting member 58 through a packing base 59 made of vinyl chloride, serving as a reinforcing member and having a good lubrication with a clamp ring 62. The clamp ring 62 is held on the fixed supporting member 54 via bolts 64 passing through a plurality of long holes 62*a* formed along the circumference of the clamp ring 62 so as to be rotatable and not be removed from the fixed supporting member 54.

Pawls 66 shaped roughly like a upside-down letter L are arranged at regular intervals around the periphery of the moveable supporting member 58 and mounted on the fixed supporting member 54. A plurality of protrusions 68 are integrally formed at intervals equivalent to those of the pawls 66 on the outer surface of the clamp ring 62. Slightly elongated holes 62*b* are formed in e.g. three locations in the clamp ring 62, as shown, for rotating the clamp ring 62. The top surface of the protrusions 68 and the bottom surface of the pawls 66 are tapered in the rotating direction in opposing directions from each other.

When the moveable supporting member 58 is in an open state, a substrate W is inserted and positioned correctly in the center of the fixed supporting member 54. The moveable supporting member 58 is closed through the hinge 56. Subsequently, the clamp ring 62 is rotated in the clockwise direction until the protrusions 68 slide under the pawls 66 shaped roughly like a upside-down letter L, thereby locking the moveable supporting member 58 to the fixed supporting member 54. By rotating the clamp ring 62 in the counter-clockwise direction, the protrusions 68 slide out from under the pawls 66 shaped roughly like a upside-down letter L, thereby unlocking the moveable supporting member 58 from the fixed supporting member 54.

As shown in FIG. 6, when the moveable supporting member 58 is locked on the fixed supporting member 54, the short leg of the seal packing 60 on the inner side is in press contact with the surface of the substrate W, while the longer leg on the outer side is in press contact with the surface of the fixed supporting member 54, thereby forming a reliable seal.

As shown in FIG. 6, conductors (electrical contact points) 70 connected to an external electrode (not shown) are disposed on the fixed supporting member 54. The edges of the conductors 70 are exposed on the surface of the fixed supporting member 54 at outer side of the substrate W. Depressions 71 are formed inside the moveable supporting member 58 through the seal packing 60 at a position facing the exposed portion of the conductors 70. A metal armature 72 is accommodated in each of the depressions 71. Each of the metal armature 72 has a rectangular cross-section with an open bottom. A spring 74 presses each of the metal armatures 72 against the fixed supporting member 54.

With this construction, when the moveable supporting member 58 is in a locked position described above, the pressing forces of the springs 74 provide electrical contacts between the exposed portions of the conductors 70 and the outer legs of the metal armatures 72, and also between the inner legs of the metal armatures 72 and the substrate W at the sealed position by the seal packing 60. In this way, electricity can be supplied to the substrate W while the substrate W is in a sealed state.

At least one of the contacting surface of the conductor 70 which contacts the metal armature 72, the contacting surface of the metal armature 72 which contacts the conductor 70, and the contacting surface of the metal armature 72 which contacts the substrate W is preferably coated with a metal such as gold or platinum by plating. Alternatively, the conductor 70 and the metal armature 72 may be made of stainless steal which has an excellent corrosion resistance.

The moveable supporting member 58 is opened and closed by a cylinder (not shown) and the weight of the moveable supporting member 58 itself. A through-hole 54*a* is formed in the fixed supporting member 54. The cylinder is provided at a position facing the through-hole 54*a* when the substrate holder 18 is mounted on the loading plate 52. With this construction, the moveable supporting member 58 is opened by extending a cylinder rod (not shown) to push the moveable supporting member 58 upward through the through-hole 54*a*. By retracting the cylinder rod, the moveable supporting member 58 closes by its own weight.

In this embodiment, the moveable supporting member 58 is locked and unlocked by rotating the clamp ring 62. A locking/unlocking mechanism is provided on the ceiling side. The locking/unlocking mechanism has pins disposed at positions corresponding to the holes 62*b* of the substrate holder 18 placed on the loading plate 52 and positioned its center side. In this state, when the loading plate 52 is raised, the pins enter the holes 62*b*. The clamp ring 62 is rotated by rotating the pins around the axial center of the clamp ring 62. Since only one locking/unlocking mechanism is provided, after locking (or unlocking) one of the substrate holders 18 placed on the loading plate 52, the loading plate 52 is slid horizontally in order to lock (or unlock) another substrate holder 18.

The substrate holder 18 is provided with a sensor for checking that the substrate W is electrically connected to a contact points when the substrate W is loaded into the substrate holder 18. Signals from the sensor are input to a controller unit (not shown).

A pair of hands 76, integrally formed on the end of the fixed supporting member 54 of the substrate holder 18 and shaped approximately like the letter T, serve as supports when transferring the substrate holder 18 and when holding the same in a suspended state. When the protruding ends of the hands 76 are caught on the upper wall in the stocker 24, the substrate holder 18 is held in a vertically suspended state. The transporter 42 of the substrate holder transferring device 40 grips the hands 76 of the substrate holder 18 in the suspended state and transfers the substrate holder 18. The substrate holder 18 is also held in a vertically suspended state on the surrounding walls of the pre-wetting tank 26, pre-soaking tank 28, cleaning tanks 30*a*, 30*b*, blowing tank 32, and copper plating tank 34.

Figure 7:
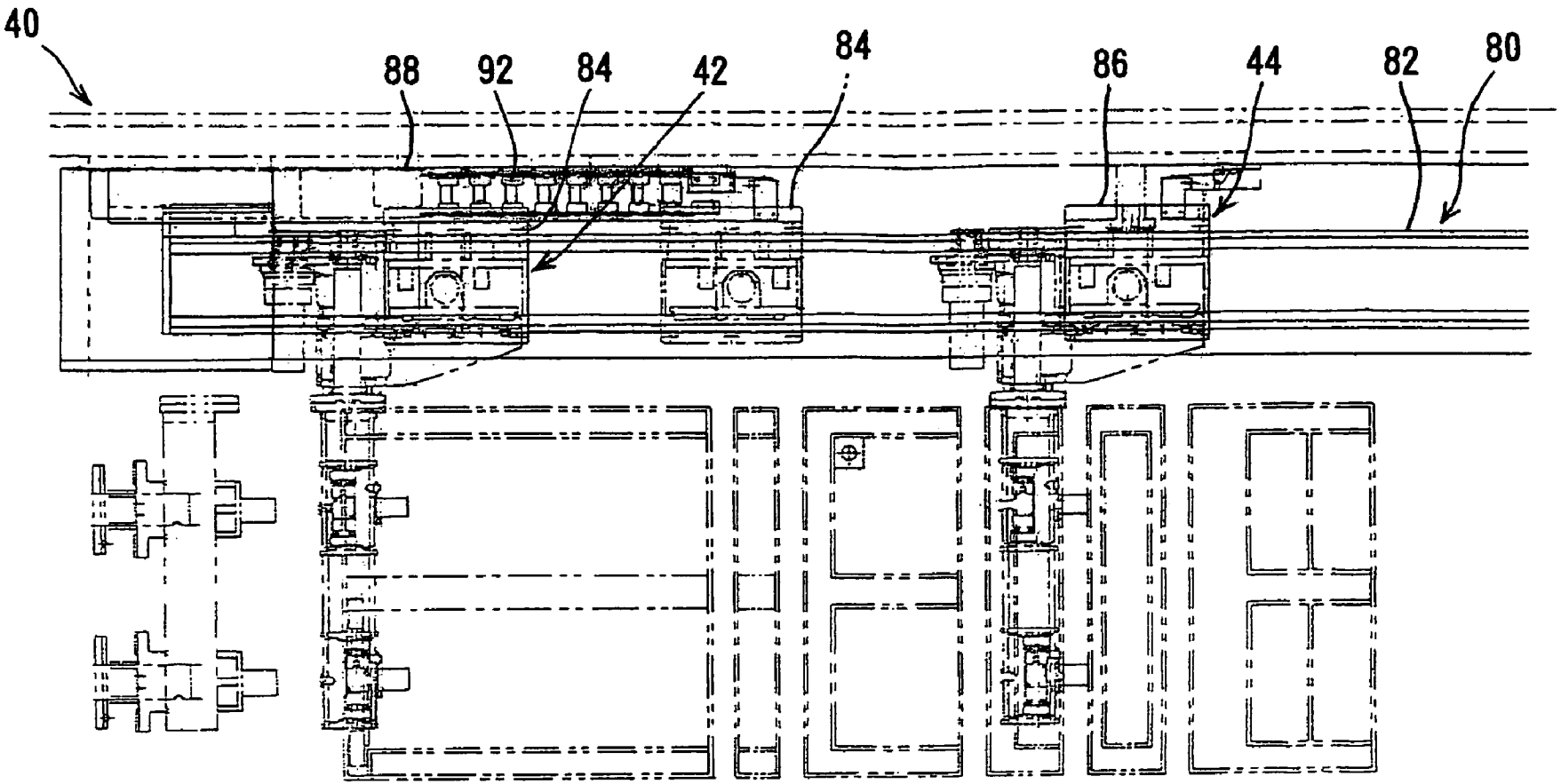
FIG. 7 is a plan view showing a linear motor section (transport section) of a substrate holder transferring device.
Figure 8:
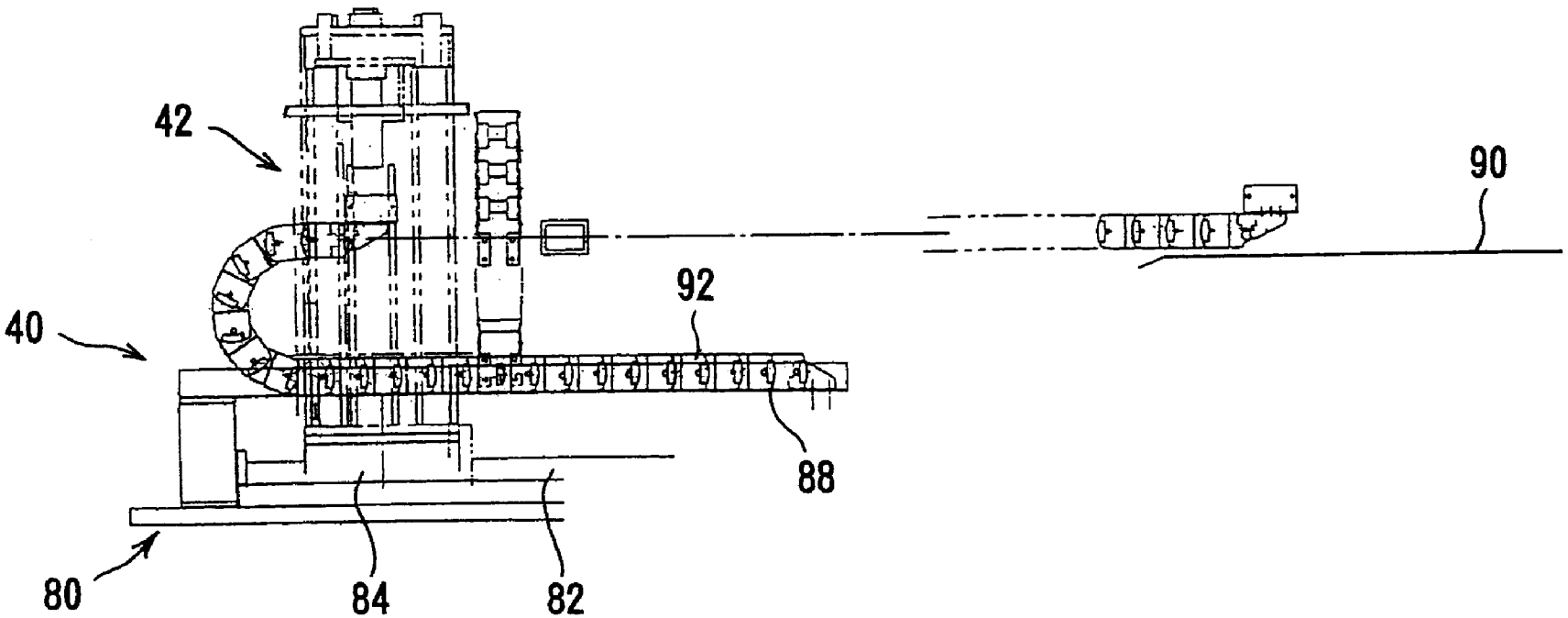
FIG. 8 is a front view of FIG. 7.

FIGS. 7 and 8 show a linear motor unit 80 serving as the transport section of the substrate holder transferring device 40. The linear motor unit 80 mainly comprises a lengthy base 82 and two sliders 84, 86 that are capable of sliding along the base 82. The transporters 42 and 44 are mounted on top of the sliders 84 and 86, respectively. A cable conveyer bracket 88 and a cable conveyer receiver 90 are provided on the side of the base 82. A cable conveyer 92 extends along the cable conveyer bracket 88 and cable conveyer receiver 90.

By employing a linear motor for moving the transporters 42, 44, these transporters 42, 44 can be moved over a long distance and the overall length of the apparatus can be shortened by shortening the length of the transporters 42, 44. Further, devices that require high-precision and maintenance, such as long ball screws, can be eliminated.

FIGS. 9 through 12 show the transporter 42. A description of the transporter 44 will be omitted here as the construction is essentially the same as that of the transporter 42. The transporter 42 mainly comprises a transporter body 100, an arm 102 protruding horizontally from the transporter body 100, an arm raising/lowering mechanism 104 for raising and lowering the arm 102, an arm rotating mechanism 106 for rotating the arm 102, and gripping mechanisms 108 provided in the arm 102 for gripping and releasing the hands 76 of the substrate holder 18.

Figure 9:
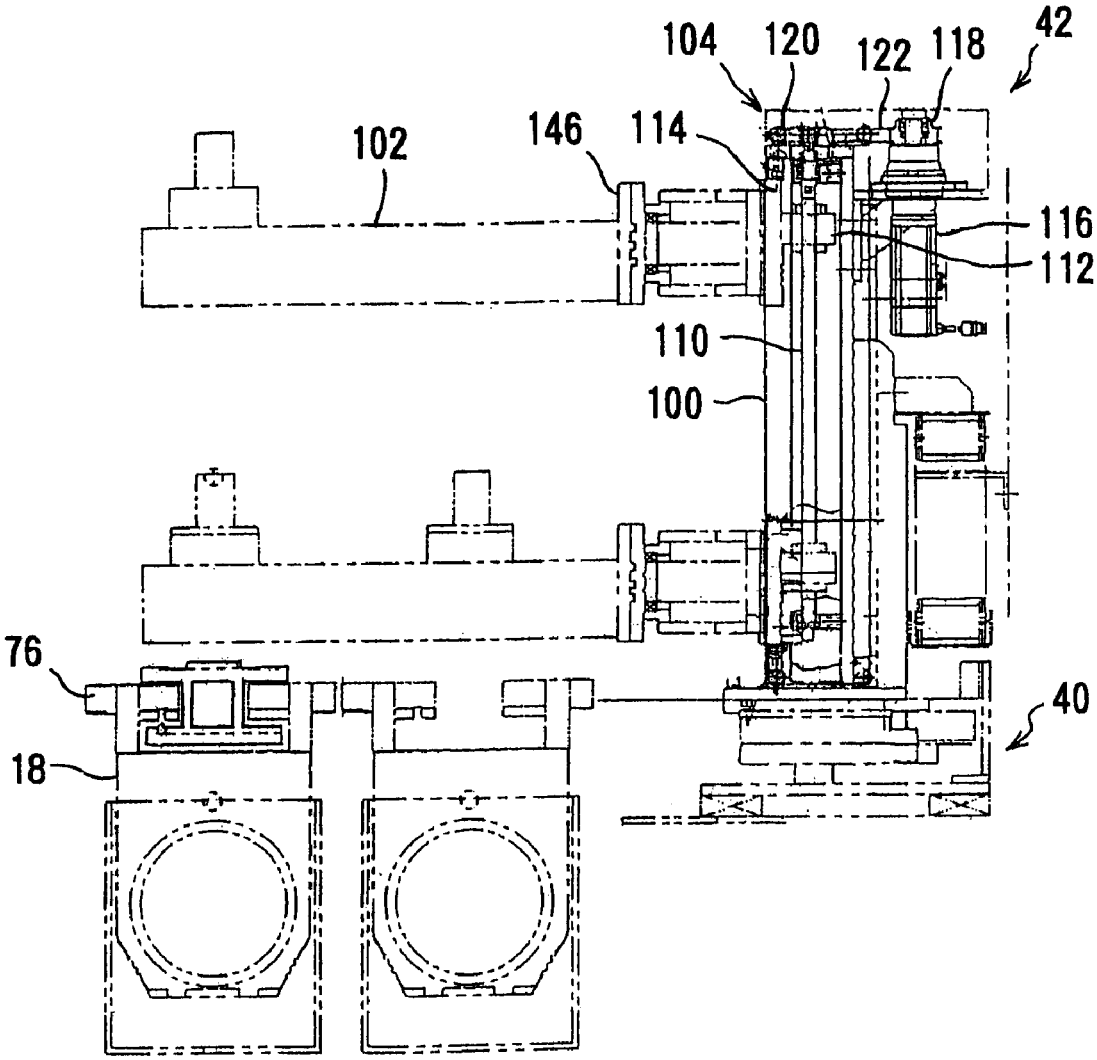
FIG. 9 is a front view of a transporter.
Figure 10:
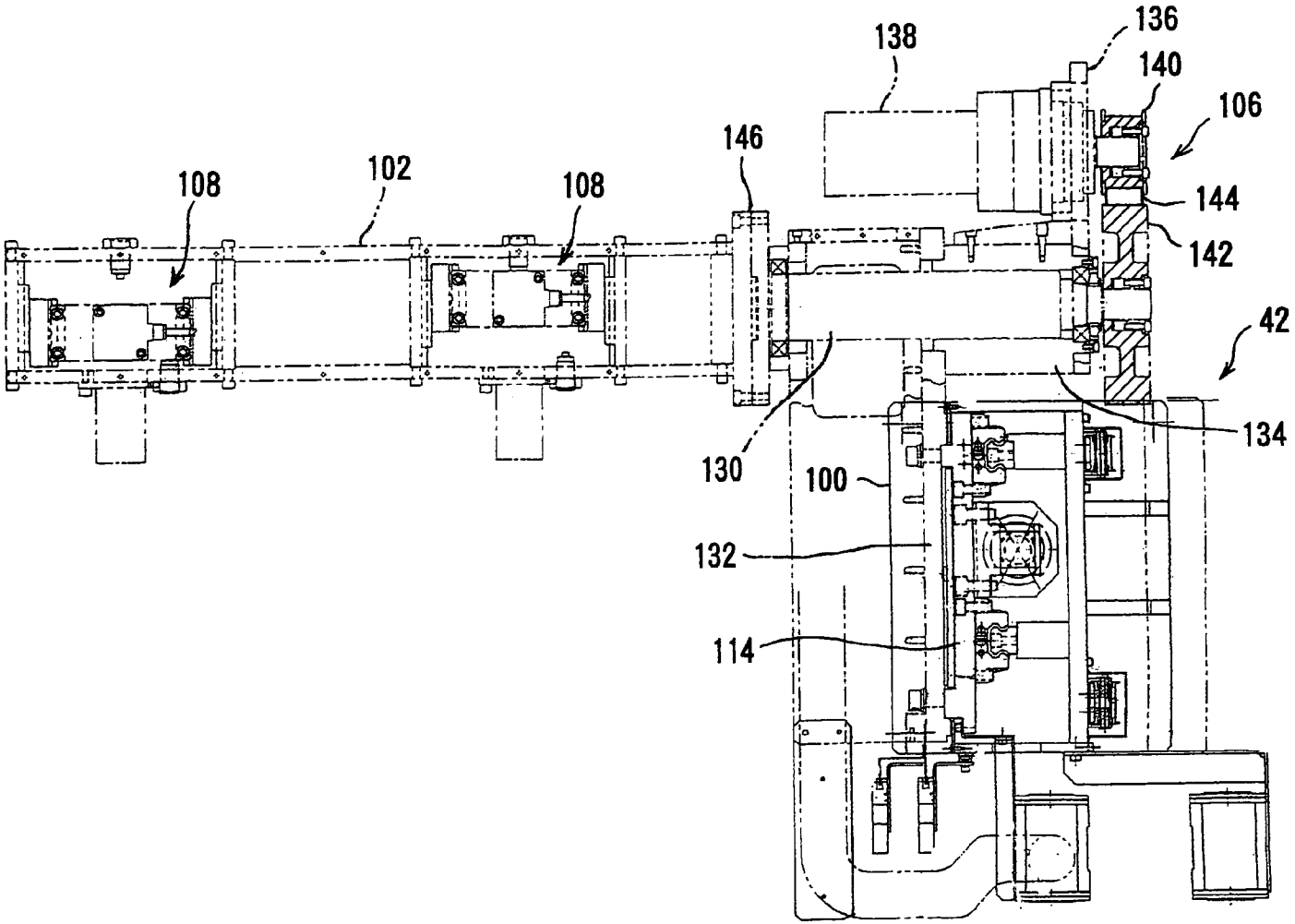
FIG. 10 is a plan view showing an arm rotating mechanism of the transporter with the phantom line.

As shown in FIGS. 9 and 10, the raising/lowering mechanism 104 includes a rotatable ball screw 110 extending vertically and a nut 112 that engages with the ball screw 110; a linear motor base 114 is connected to the nut 112. A timing belt 122 is looped around the drive pulley 118 fixed to the drive shaft of the raising/lowering motor 116 mounted on the transporter body 100 and a follow pulley 120 fixed to the top end of the ball screw 110. With this construction, the raising/lowering motor 116 drives the ball screw 110 to rotate. The rotation of the ball screw 110 raise and lower the linear motor base 114 connected to the nut 112, engaging with the ball screw 110, along a linear motor guide.

As shown in FIG. 10 by the phantom line, the arm rotating mechanism 106 includes a sleeve 134 that rotatably accommodates a rotating shaft 130 and fixed to the linear motor base 114 via a mounting base 132, and a rotating motor 138 fixed to the end of the sleeve 134 via a motor base 136. A timing belt 144 looped around a drive pulley 140 fixed to the drive shaft of the rotating motor 138 and a follow pulley 142 fixed to the end of the rotating shaft 130. With this construction, the rotating motor 138 drives the rotating shaft 130 to rotate. The arm 102 is linked to the rotating shaft 130 through a coupling 146 and therefore raises and lowers and rotates together with the rotating shaft 130.

Figure 11:
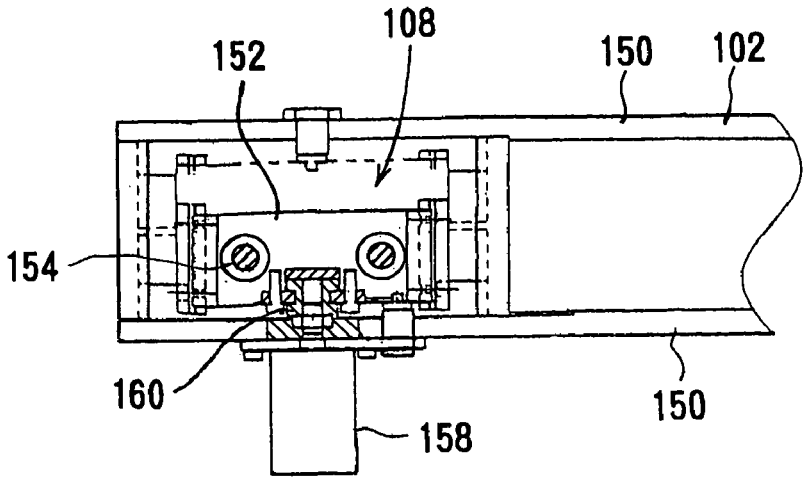
FIG. 11 is a plan view showing a gripping mechanism provided in the arm.
Figure 12:
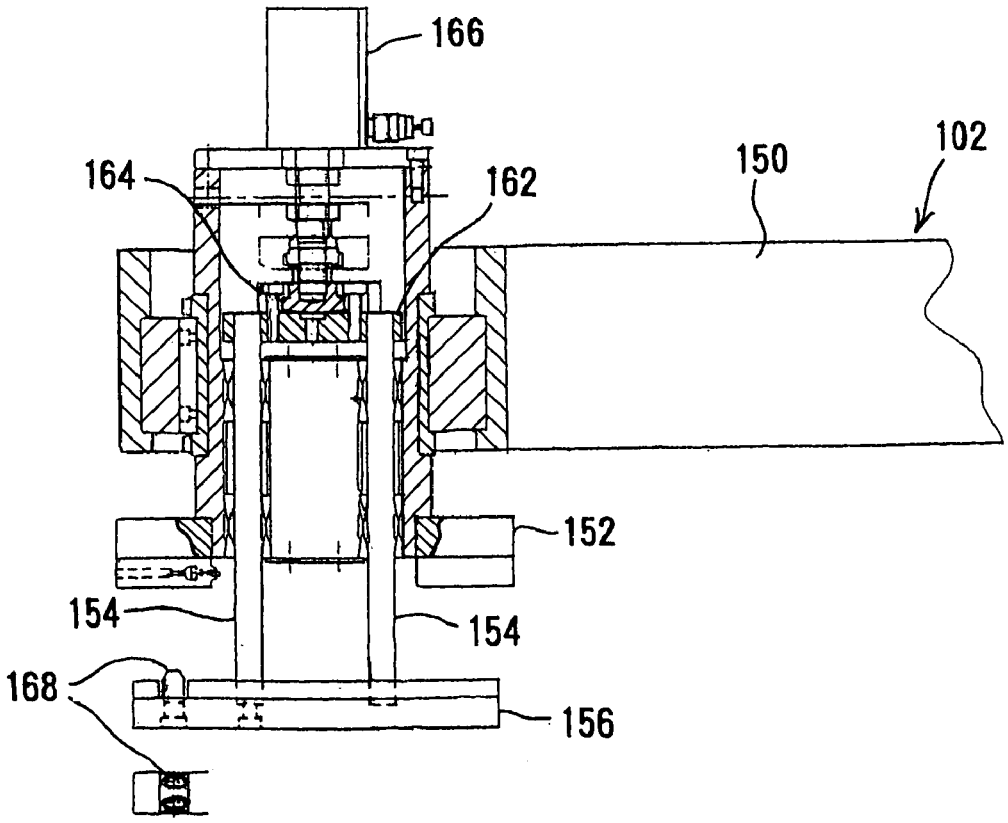
FIG. 12 is a longitudinal sectional front view of the gripping mechanism.

As shown in FIGS. 11 and 12 and indicated by the phantom line in FIG. 10, the arm 102 includes a pair of side plates 150 that are coupled with the rotating shaft 130 and rotate together with the same. The gripping mechanisms 108 are disposed between the side plates 150, 150. Two gripping mechanisms 108 are provided in this example. However, only a description of one will be given, as both have the same construction.

The gripping mechanism 108 includes a fixed holder 152, the end of which is accommodated between the side plates 150, 150 and is capable of moving freely in the widthwise direction; guide shafts 154 penetrating through the inner portion of the fixed holder 152; and a moveable holder 156 connected to one end (the bottom end in FIG. 12) of the guide shafts 154. A cylinder 158 for movement in the widthwise direction is mounted on one of the side plates 150. The fixed holder 152 is coupled to the cylinder 158 through a cylinder joint 160. A shaft holder 162 is mounted on the other end (the upper end in FIG. 12) of the guide shafts 154. The shaft holder 162 is coupled to a cylinder 166 for vertical movement through a cylinder connector 164.

With this construction, the fixed holder 152 together with the moveable holder 156 moves in the widthwise direction between the side plates 150, 150 with the operations of the cylinder 158. Further, the moveable holder 156 moves up and down, while being guided by the guide shafts 154 with the operations of the cylinder 166.

When the gripping mechanism 108 grips the hands 76 of the substrate holder 18 that is suspended in the stocker 24 and the like, the moveable holder 156 can be lowered to below of the hands 76 while avoiding interference with the hands 76. Subsequently, the cylinder 158 is operated to position the fixed holder 152 and moveable holder 156 above and below the hands 76, thereby interposing the hands 76 between the fixed holder 152 and moveable holder 156. In this state, the cylinder 166 is operated to grip the hands 76 between the fixed holder 152 and moveable holder 156. The grip is released by performing this operation in reverse.

As shown in FIG. 4, a depression **76*a* is formed on one of the hands 76 of the substrate holder 18. A protrusion 168 for engaging the depression 76*a* is provided on the moveable holder 156 at a position corresponding to the depression 76*a***, enabling a more reliable grip.

FIGS. 13 through 16 shows a copper plating tank 34 accommodating four copper plating units 38 in two rows. The copper plating tank 34 accommodating eight plating units 38 in two rows, shown in FIG. 3A, has essentially the same construction. The construction of the copper plating tank 34 is the same when increasing the number of copper plating units.

The copper plating tank 34 is provided with an overflow tank 36 formed in a rectangular box shape with an open top. The overflow tank 36 includes the tops of peripheral walls 170 that protrude higher than the tops 180 of peripheral walls 172 on each of the plating units 38 accommodated in the overflow tank 36. A plating liquid channel 174 is formed around the plating units 38 when the plating units 38 are accommodated in the overflow tank 36. A pump inlet port 178 is provided in the channel 174. With this construction, a plating liquid that overflows the plating units 38 flows into the channel 174 and is discharged through the pump inlet port 178. Further, the overflow tank 36 is provided with a liquid leveler (not shown) for maintaining the plating liquid in each of the plating units 38 at a uniform level.

Figure 13:
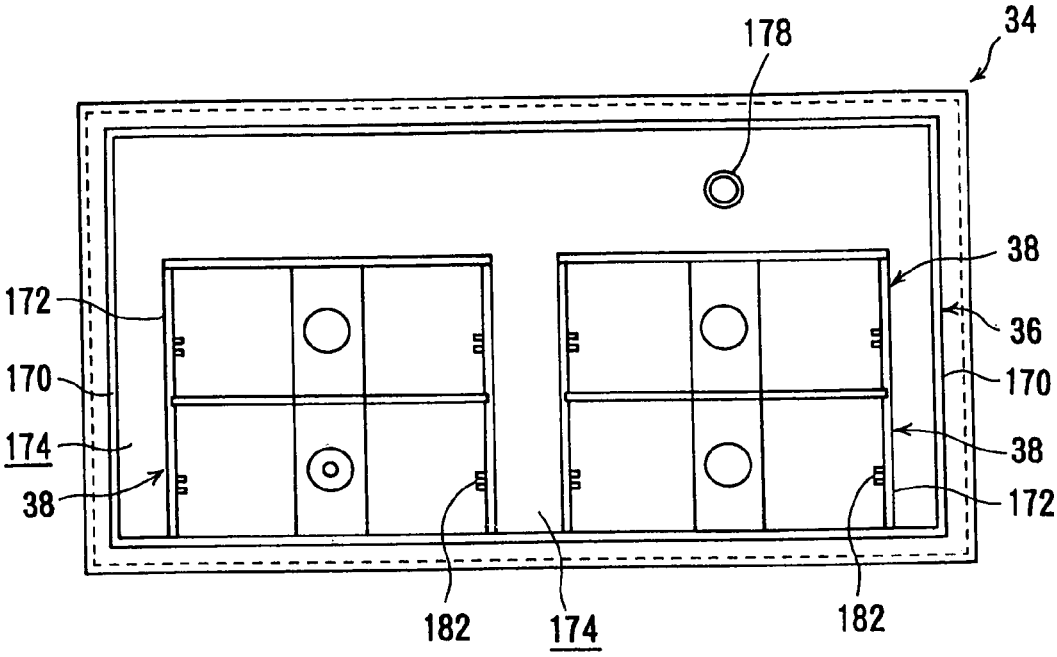
FIG. 13 is a plan view of a copper plating tank.
Figure 14:
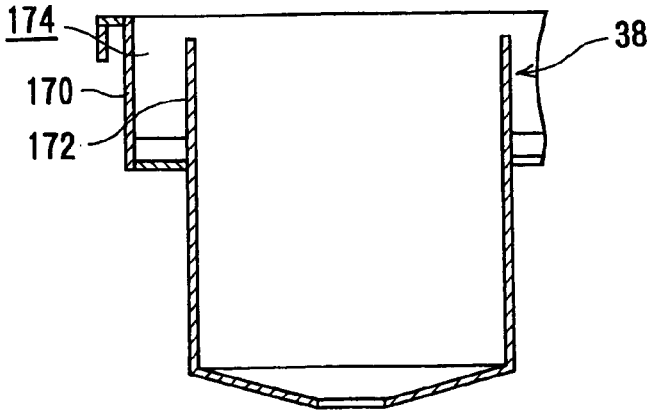
FIG. 14 is a longitudinal sectional front view of FIG. 13.
Figure 15A:
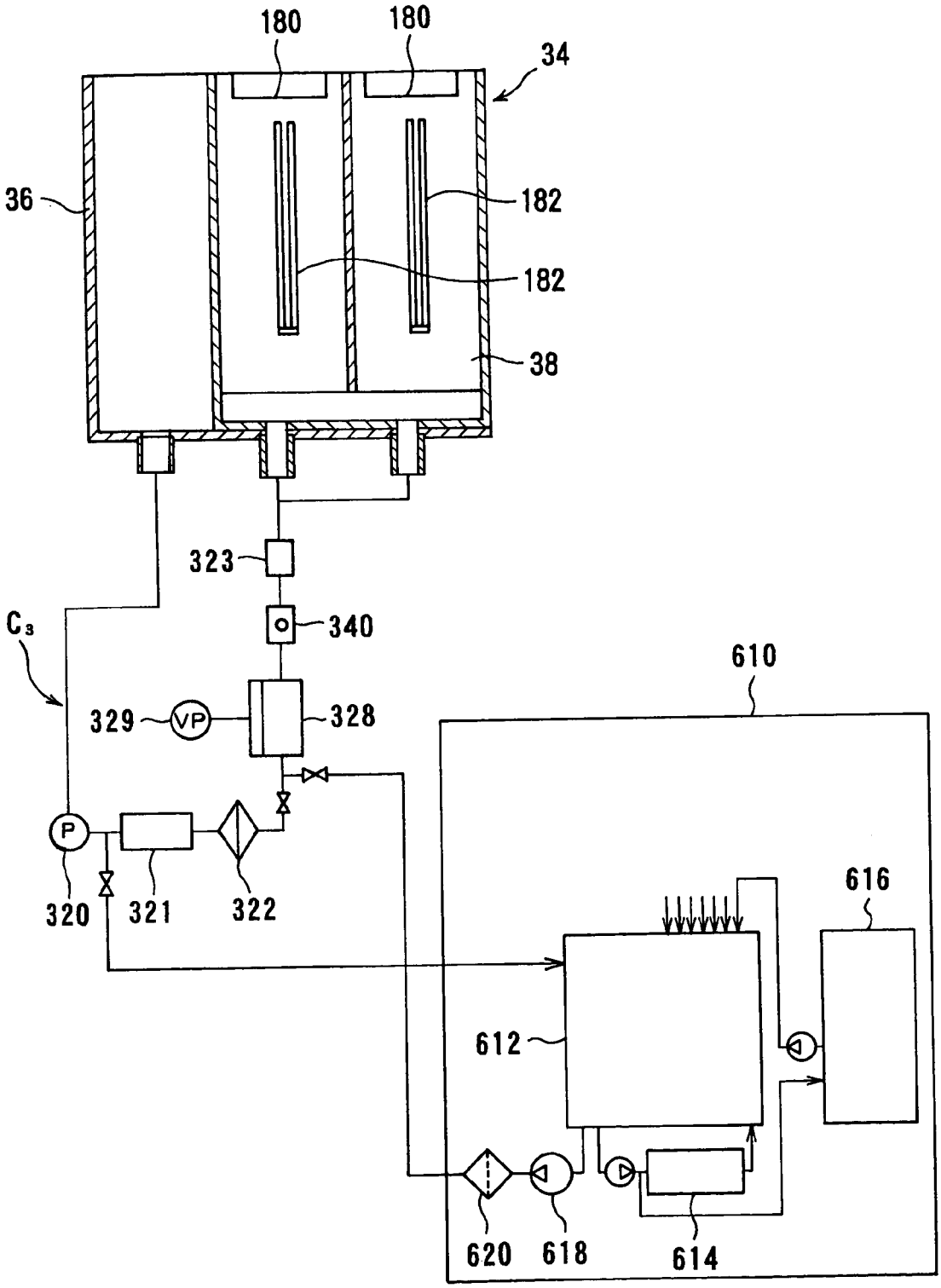
FIG. 15A is a longitudinal sectional side view of the copper plating tank.

As shown in FIGS. 13 and 15A, insertion grooves 182 are provided on the inner side surfaces of the plating units 38 for guiding the substrate holder 18.

As described above, a plating liquid circulation system $C_3$ is provided for circulating the plating liquid Q which overflows the plating units 38 and collects in the overflow tank 36 with the vacuum pump 320. The vacuum pump 320 circulates the plating liquid Q through a temperature regulating unit 321, a filter 322, a deaerator (deaerating unit) 328, a dissolved oxygen concentration measuring unit 340, and a flow meter 323 back to inside of the copper plating units 38. The deaerator 328 is provided with a vacuum pump 329 for removing various dissolved gases, including oxygen, air, and carbon dioxide, from the plating liquid Q flowing through the circulation system using a membrane. The membrane allows only gases to pass therethrough, while preventing the passage of liquid.

A plating liquid regulating unit 610 is further provided in a branch off the plating liquid circulation system $C_3$ for analyzing the plating liquid while one-tenth of the overall plating liquid, for example, is extracted. Based on the analysis results, components that are lacking in the plating liquid are added to the plating liquid. The plating liquid regulating unit 610 includes a plating liquid regulating tank 612 in which components lacking in the solution are added. A temperature controller 614 and a plating liquid analyzing unit 616 for extracting and analyzing a sample of plating liquid are disposed adjacent to the plating liquid regulating tank 612. The plating liquid returns from the plating liquid regulating tank 612 to the plating liquid circulation system $C_3$ through a filter 620 by the operation of a pump 618.

In this example, the plating apparatus of the present invention employs both a feedforward control method for predicting disturbances based on the processing time and the number of substrates plated and adding components to be needed, and a feedback control method for analyzing the plating liquid and adding components that are lacking in the plating liquid based on the results on that analysis. Of course, it is also possible to use only the feedback control method.

Figure 3D:
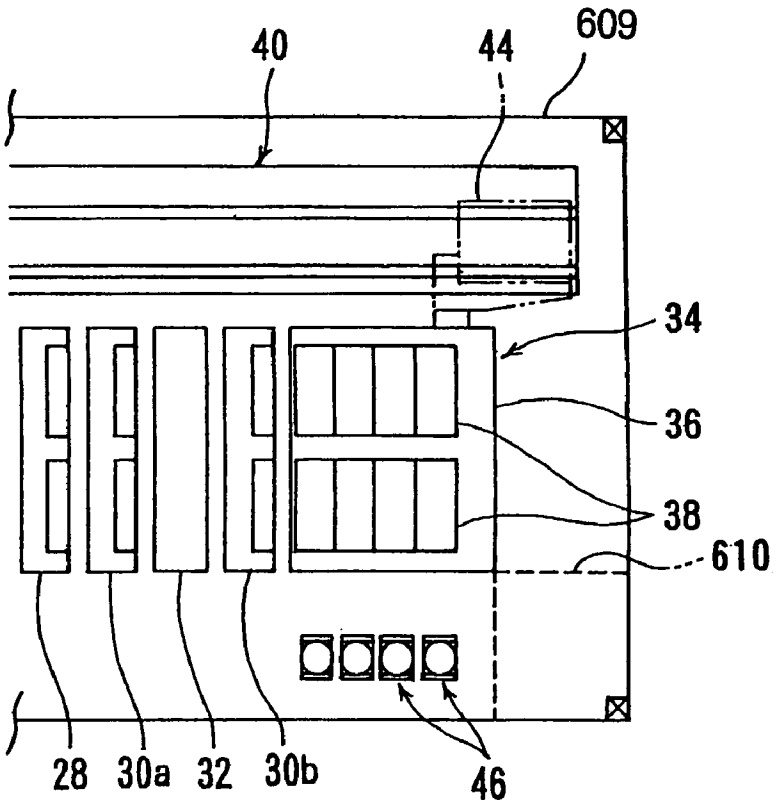
FIG. 3D is a plan view showing an arrangement of a plating liquid regulating unit.
Figure 3E:
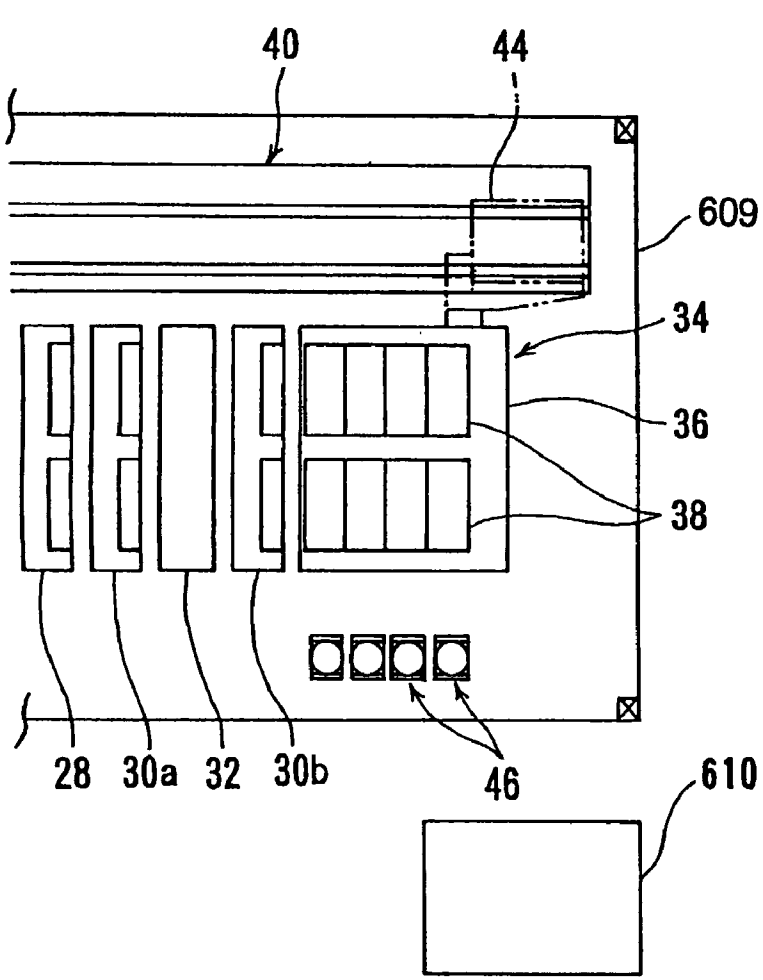
FIG. 3E is a plan view showing another arrangement of the plating liquid regulating unit.

As shown in FIG. 3D, the plating liquid regulating unit 610 is disposed in a housing 609, for example, that accommodates the cassette tables 12, substrate loading/unloading unit 20, stocker 24, pre-wetting tank 26, pre-soaking tank 28, cleaning tanks 30*a*, 30*b*, and copper plating tank 34. The plating liquid regulating unit 610 can also be positioned outside the housing 609, as shown in FIG. 3E.

Figure 15B:
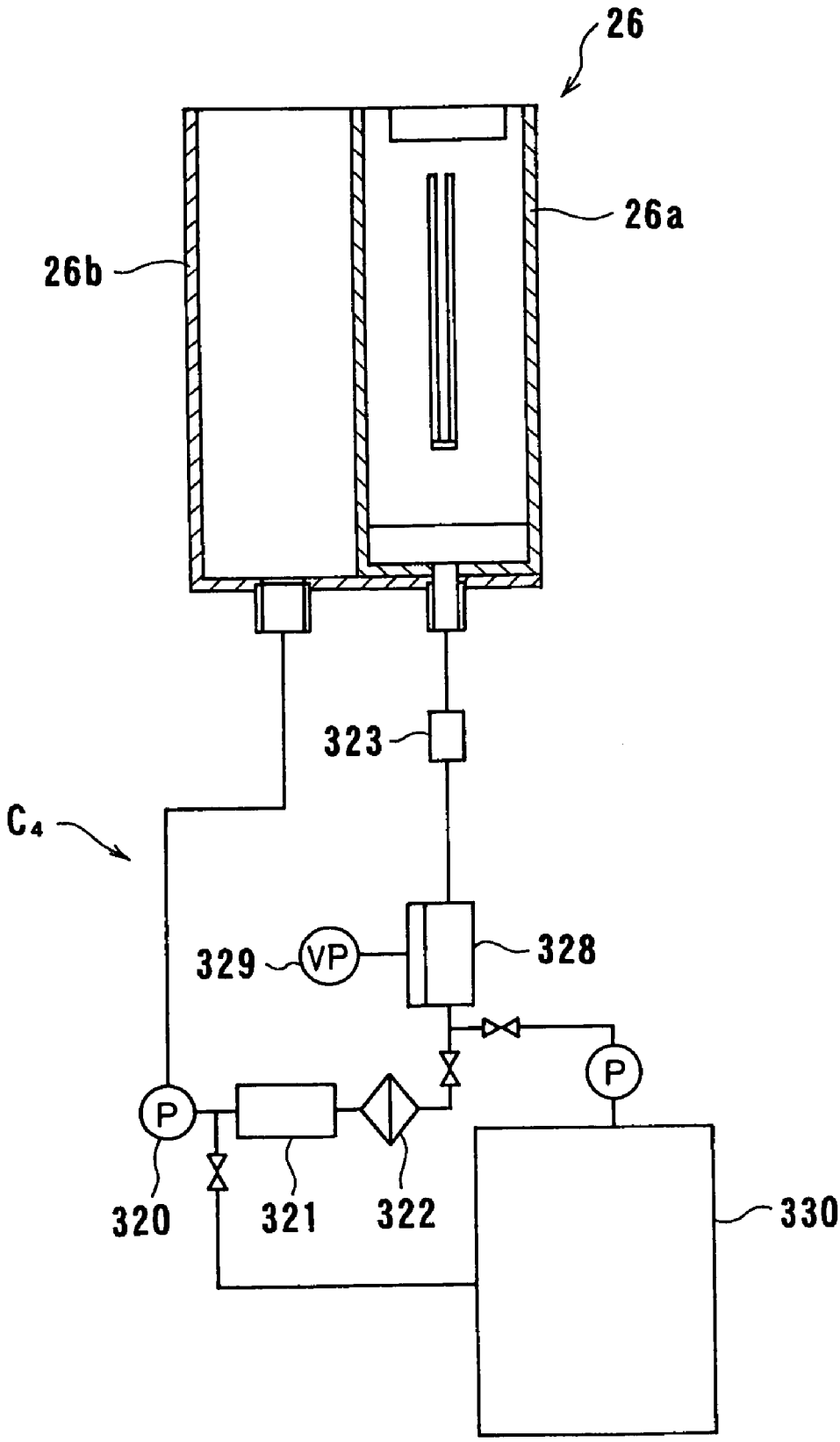
FIG. 15B is a longitudinal sectional side view of a pre-wetting tank.

As shown in FIG. 15B, the pre-wetting tank 26 is provided with a pure water circulation system $C_4$ which collects the pure water that has overflowed the pre-wetting unit 26*a* in the overflow tank 26*b*, and returns the pure water to inside the pre-wetting unit 26*a* through a temperature regulating unit 321, a filter 322, a deaerator (deaerating unit) 328, and a flow meter 323 by a vacuum pump 320. The deaerator 328 is provided with a vacuum pump 329 for removing various dissolved gases, including oxygen, air, and carbon dioxide, from the pure water flowing through the circulation system using a membrane. The membrane allows only gases to pass therethrough, while preventing the passage of liquid. A pure water tank 330 for supplying the pure water to the pure water circulation system $C_4$ is provided.

Figure 16:
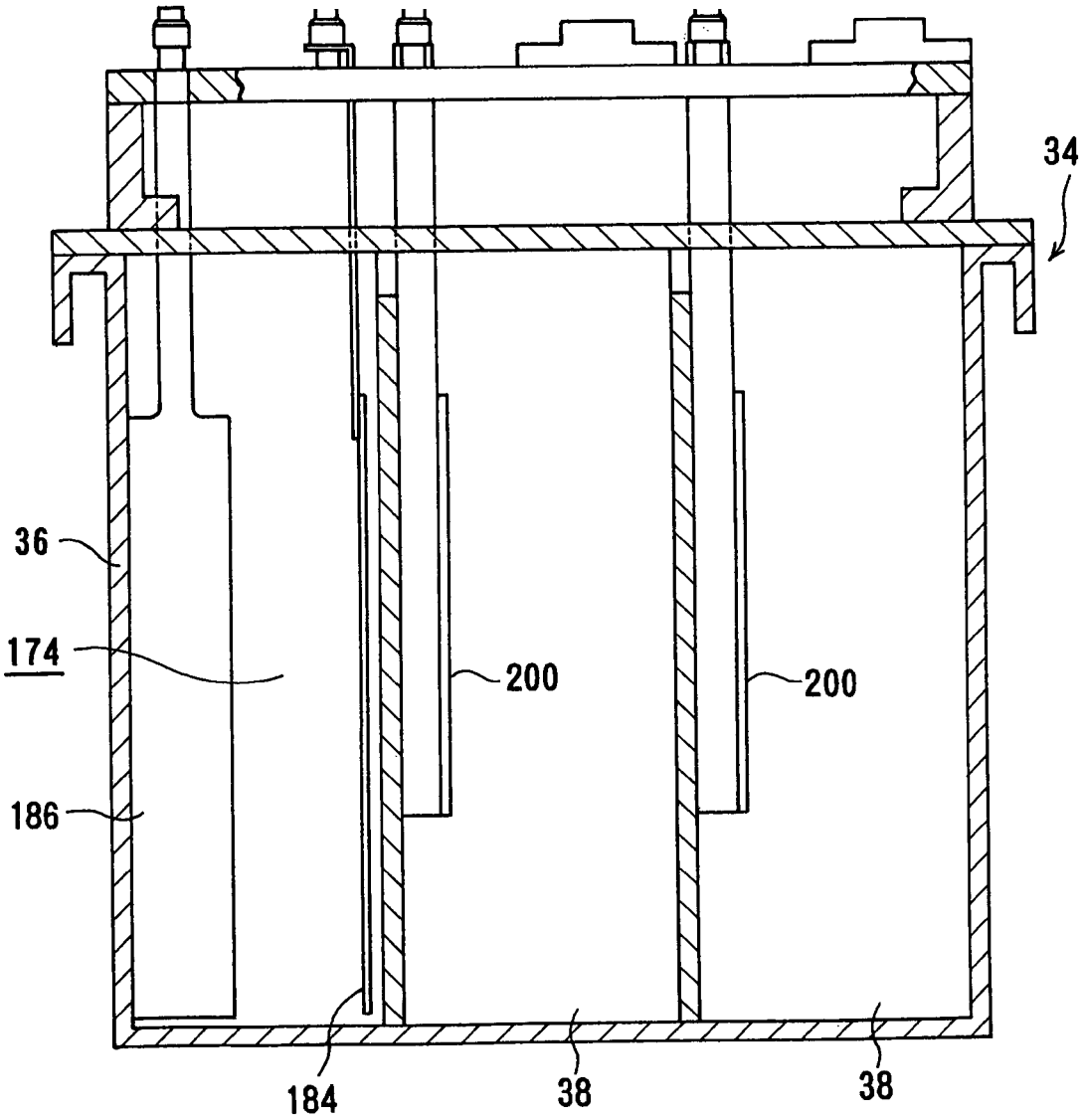
FIG. 16 is an enlarged cross-sectional view of the copper plating tank.

As shown in FIG. 16, a plating cathode 184 and an anode 186 for dummy plating are disposed in the plating liquid channel 174. The anode 186 can be formed of a titanium basket, for example, in which copper chips or the like are inserted. In this way, the overflow tank 36 can serve as a plating tank, thereby not only eliminating uneven plating in the plating units 38, but also increasing the surface of the dummy electrode for improving the efficiency of dummy plating. Further, by circulating most of the plating liquid through the dummy plating section, it is possible to facilitate formation of a uniform plating liquid.

Figure 17:
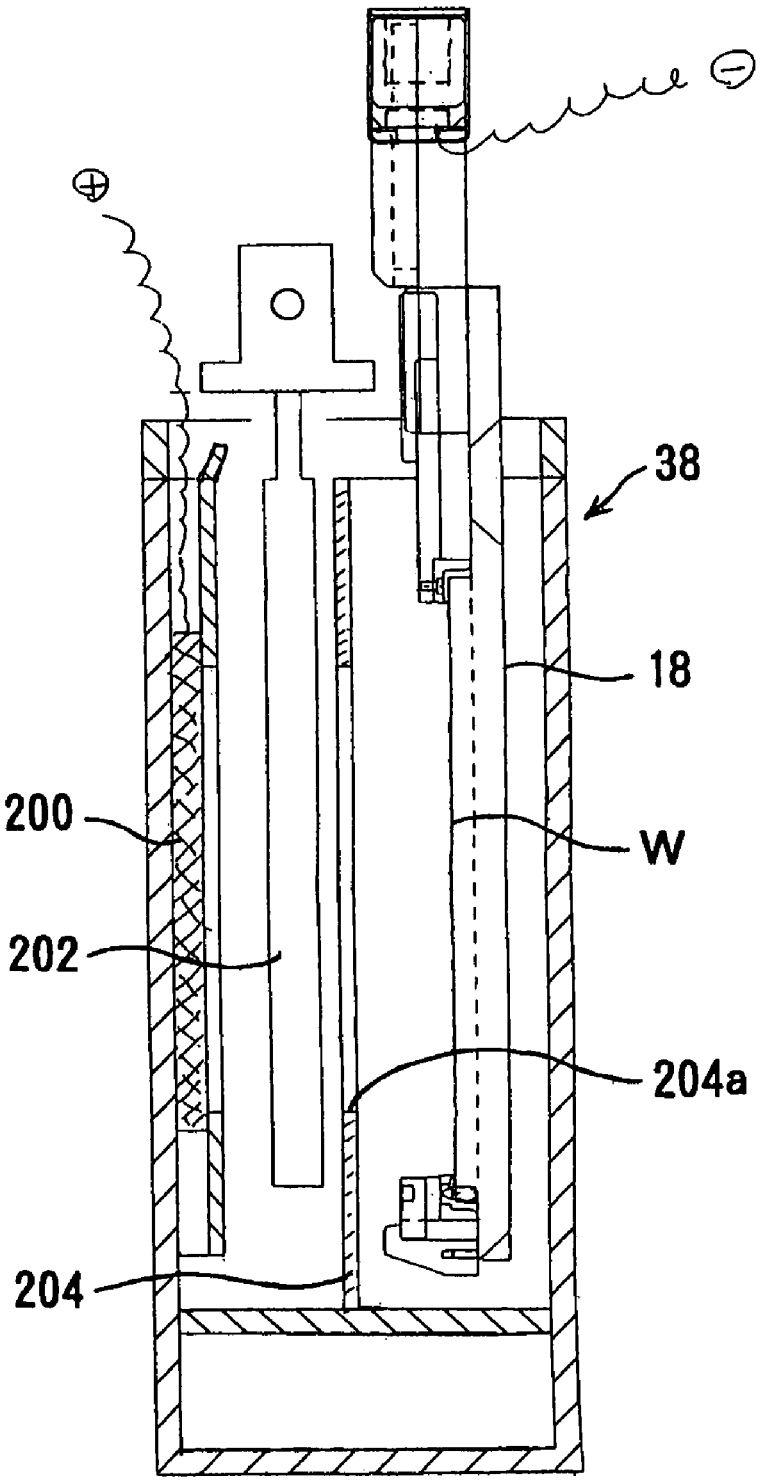
FIG. 17 is an enlarged cross-sectional view of a copper plating unit.

FIG. 17 shows a cross-sectional view of the copper plating unit 38. As shown in FIG. 17, an anode 200 is disposed in the plating unit 38 at a position facing the surface of the substrate W when the substrate holder 18 holding the substrate W is disposed along the insertion grooves 182 (see FIGS. 13 and 15). The paddle 202 is positioned substantially vertical between the anode 200 and substrate W. The paddle 202 can reciprocate in a direction parallel to the substrate W by the paddle driving unit 46, which will be described in more detail below.

By providing the paddle 202 between the substrate W and the anode 200, and reciprocating the paddle 202 in a direction parallel to the surface of the substrate W, a uniform flow of plating liquid can be created across the entire surface of the substrate W, thereby forming a plated film with a uniform thickness over the entire surface of the substrate W.

In this example, a regulation plate 204 (mask) formed with a center hole 204*a* that corresponds to the size of the substrate W is provided between the substrate W and the anode 200. The regulation plate 204 lowers an electrical potential around the periphery of the substrate W, thereby achieving an even more uniform thickness of the plated film.

Figure 18:
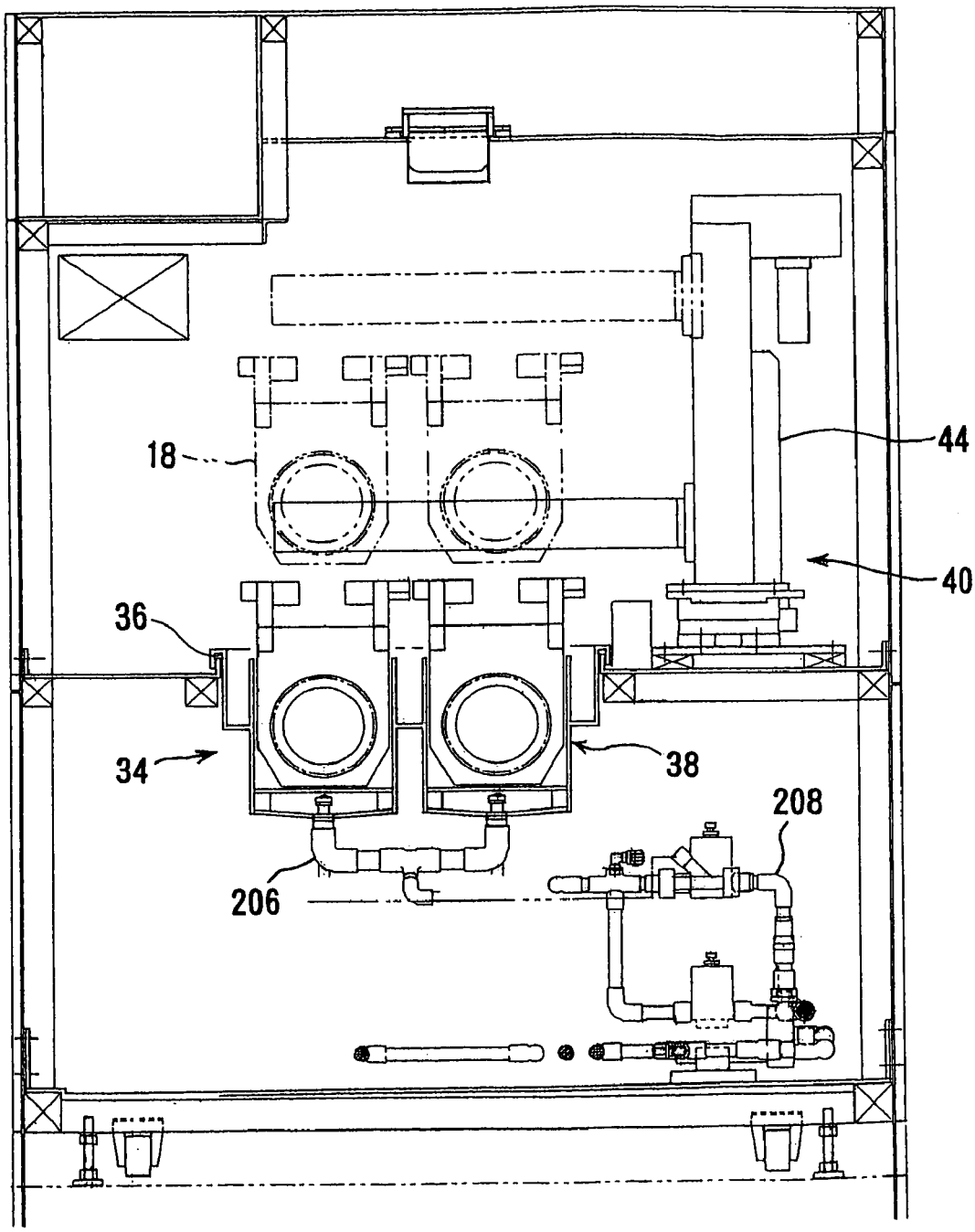
FIG. 18 is a cross-sectional view of the section including the copper plating tank shown in FIG. 3A.
Figure 19:
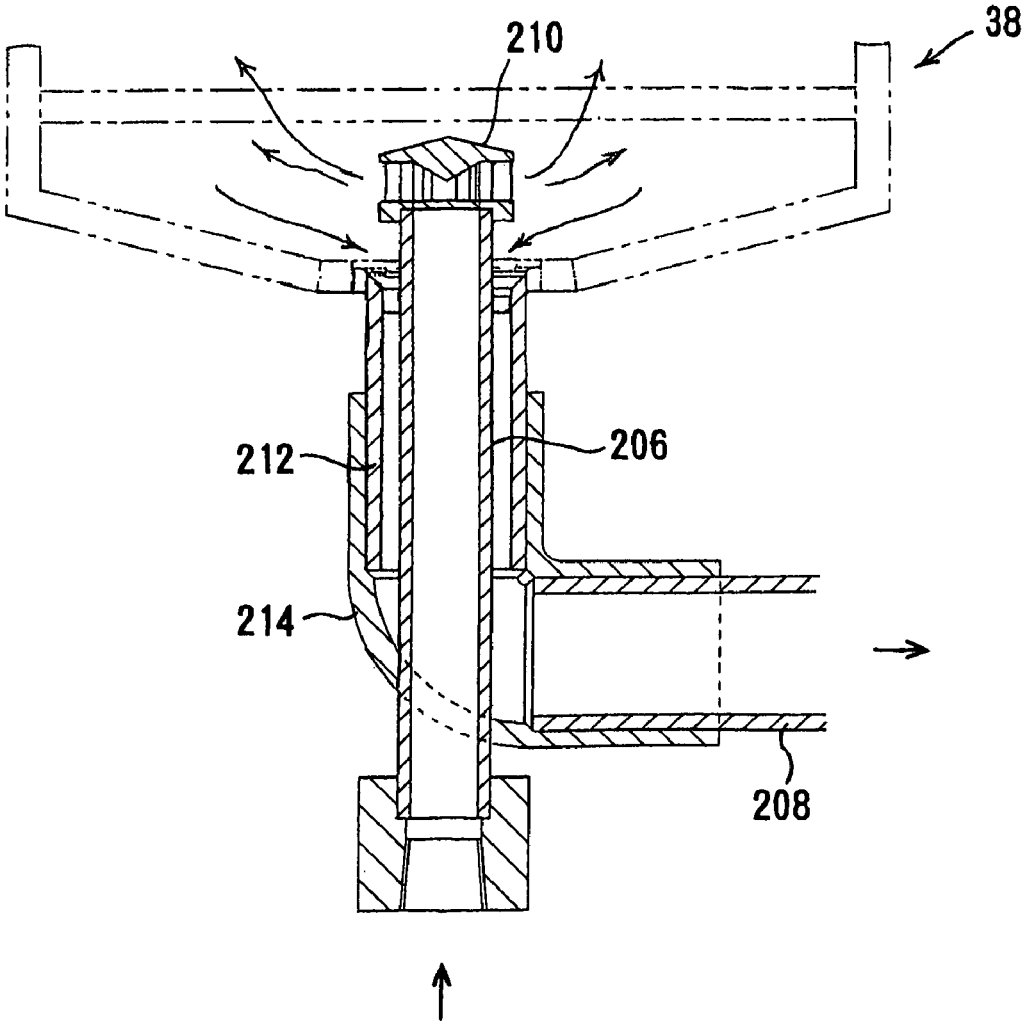
FIG. 19 is an enlarged cross-sectional view of the portion of the copper plating unit around a plating liquid injection pipe.

FIG. 18 shows a cross-section of the portion of the plating apparatus in which the copper plating tank 34 is disposed. FIG. 19 shows a more detailed view of the plating liquid injecting portion of FIG. 18. As shown in FIG. 18, the plating liquid is supplied to the plating units 38 through plating liquid supply pipes 206 disposed lower the plating units 38. The plating liquid that overflows the overflow tank 36 is discharged through a plating liquid discharge pipe 208 disposed at the lower part.

As shown in FIG. 19, the plating liquid supply pipes 206 are opened inside the plating units 38 at the bottom of them. A regulating plate 210 is mounted at the open end of the plating liquid supply pipe 206. The plating liquid is injected through the regulating plate 210 into the plating unit 38. A waste solution pipe 212 is attached at one open end to the plating unit 38 and positioned around the plating liquid supply pipe 206, while the other end of the waste solution pipe 212 is connected to the plating liquid discharge pipe 208 through an elbow pipe 214. With this configuration, the plating liquid near the plating liquid supply pipe 206 is discharged through the waste solution pipe 212 and plating liquid discharge pipe 208, preventing the plating liquid from being stagnant at this point.

Figure 20:
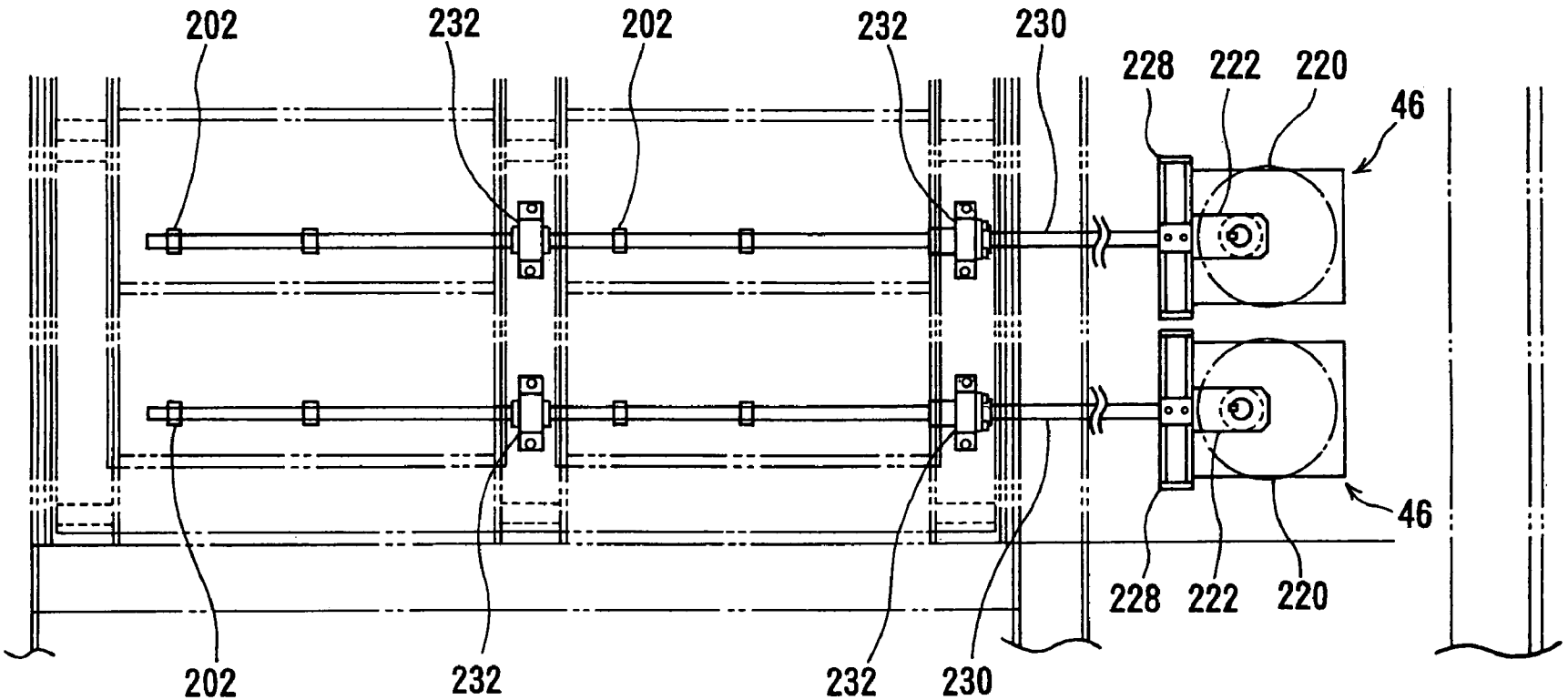
FIG. 20 is a plan view of a paddle drive device.
Figure 21:
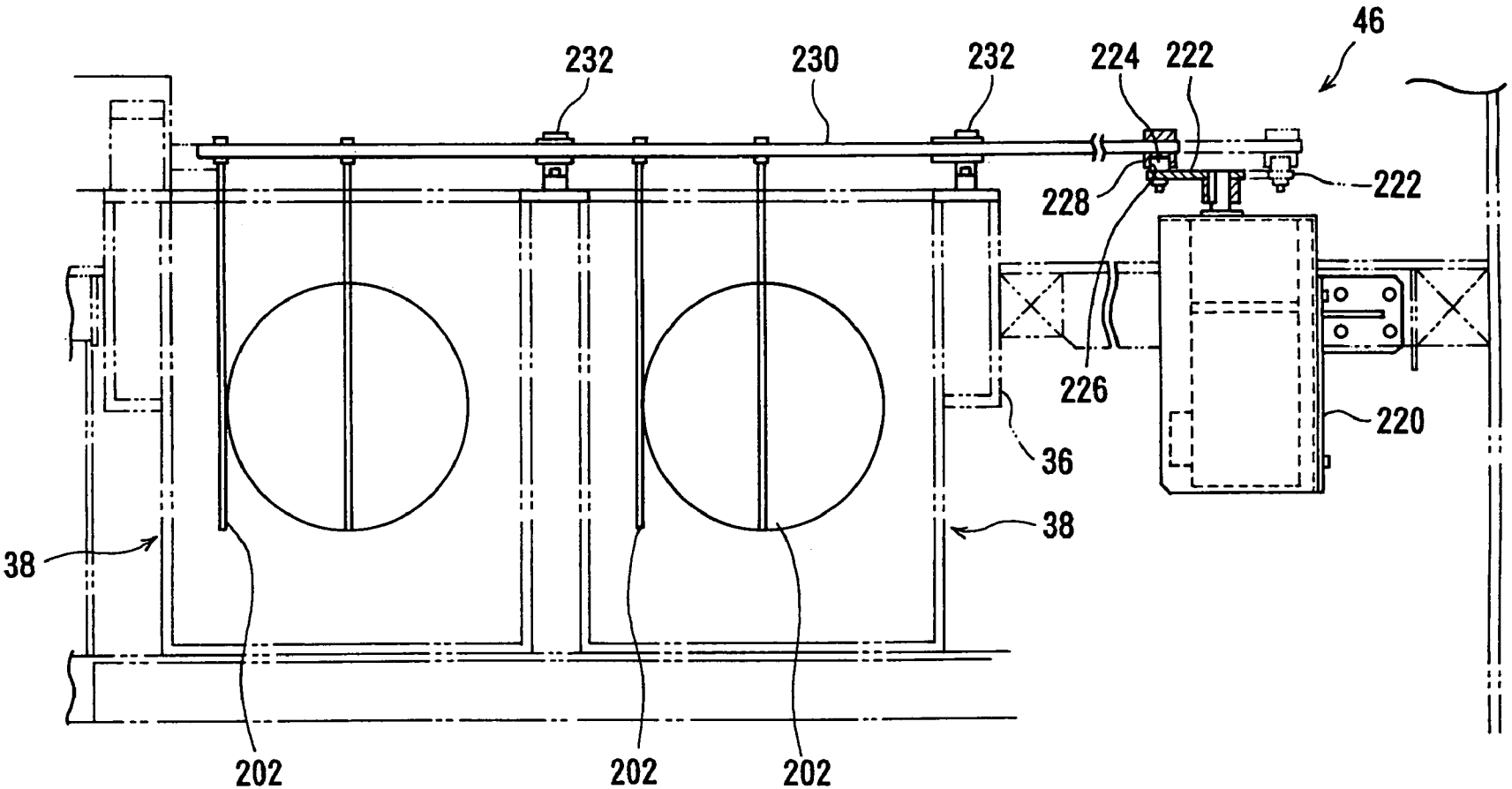
FIG. 21 is a longitudinal sectional front view of the paddle drive device.

FIGS. 20 and 21 show the paddle driving units 46. In this example, a plurality of paddle driving units 46 are provided. Although FIGS. 20 and 21 show only two paddle driving units 46, each of the paddle driving units 46 has the same construction. Therefore, duplicate descriptions of this part will be omitted by designating the same reference number.

The paddle driving unit 46 is provided with a paddle drive motor 220, a crank 222 coupled to a drive shaft of the paddle drive motor 220, a cam follower 224 mounted on the far end of the crank 222, and a slider 228 having a grooved cam 226 in which the cam follower 224 slides. A paddle shaft 230 is coupled to the slider 228 and disposed across the copper plating tank 34. The paddle 202 is vertically attached at prescribed locations along the length of the paddle shaft 230. A shaft guide 232 supports the paddle shaft 230 and only allow the paddle shaft 230 to reciprocate in the lengthwise direction.

With this construction, the drive of the paddle drive motor 220 rotates the crank 222. The rotating movement of the crank 222 is converted into linear movement in the paddle shaft 230 by the slider 228 and the cam follower 224. As described above, the paddle 202 attached vertically to the paddle shaft 230 reciprocates in a direction parallel to the substrate W.

Different diameters of substrates W can be easily handled by adjusting the mounting position of the paddle 202 on the paddle shaft 230 to a desirable position. Since the paddle 202 reciprocates constantly during the plating process, this movement has generated wear in the mechanical parts and has caused the generation of particles through the mechanical sliding. In this example, however, the construction of the paddle support units has been improved, thereby improving the durability of the mechanism and greatly reducing the occurrence of such problems.

Figure 29A:
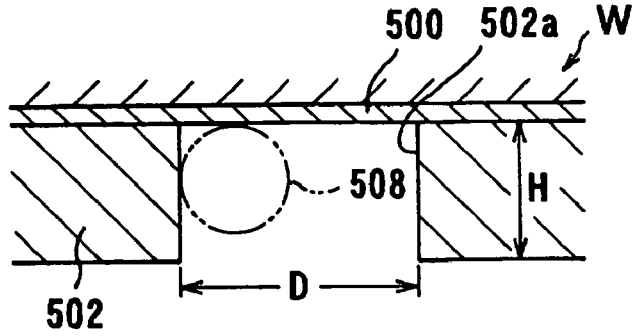
FIG. 29A PRIOR ART
FIGS. 29A through 29E are cross-sectional views illustrating the process steps for forming a bump (protruding electrode) on a substrate.

Next, a plating process will be described for plating a series of bump electrodes using the plating apparatus of the embodiments described above. As shown in FIG. 29A, a seed layer 500 as an electric feed layer is formed on the surface of a substrate. A resist 502 having a height H of e.g. 20-120 μm is applied over the entire surface of the seed layer 500. Subsequently, an opening 502*a* having a diameter D of e.g. 20-200 μm is formed at a prescribed position in the resist 502. Such a substrate W is inserted in the cassette 10 described above with the surface (processing surface to be plated) facing upward. The cassette 10 is loaded onto the cassette table 12.

The substrate transferring device 22 takes out one substrate from the cassette 10 on the cassette table 12 and places the substrate on the aligner 14. The aligner 14 aligns the orientation flat or notch or the like in the prescribed orientation.

Next, the substrate transferring device 22 transfers the aligned substrate W to the substrate loading/unloading unit 20.

In the substrate loading/unloading unit 20, two substrate holders 18 accommodated in the stocker 24 are gripped by the gripping mechanisms 108 of the transporter 42 of the substrate holder transferring device 40 simultaneously. After the arm raising/lowering mechanism 104 raises the arm 102, the arm 102 is moved to the substrate loading/unloading unit 20. The arm rotating mechanism 106 rotates the arm 102 at 90° to hold the substrate holders 18 in a horizontal state. Subsequently, the arm raising/lowering mechanism 104 lowers the arm 102, placing both substrate holders 18 on the loading plate 52 simultaneously. The cylinders are operated to open the moveable supporting members 58 of the substrate holders 18.

While the moveable supporting members 58 are open, the substrate transferring device 22 inserts the substrate into one of the substrate holders 18 positioned in the center of the substrate loading/unloading unit 20. The cylinder performs a reverse operation to close the moveable supporting member 58. Subsequently, the moveable supporting member 58 is locked by the locking/unlocking mechanism. After one substrate W is loaded into one substrate holder 18, the loading plate 52 is slid horizontally to load another substrate in the other substrate holder 18. Subsequently, the loading plate 52 is returned to its original position.

Thus, each of the surface of the substrate to be plated is exposed in the opening portion of the substrate holder 18. The seal packing 60 seals the peripheral portion of the substrates W to prevent the plating liquid from entering thereinto. Electricity is continued through the plurality of contact points in areas not in contact with the plating liquid. Wiring is connected from the contact points to the hands 76 of the substrate holder 18. By connecting a power source to the hands 76, electricity can be supplied to the seed layer 500 formed on the substrate.

Next, the gripping mechanisms 108 of the transporter 42 of the substrate holder transferring device 40 grip both of the substrate holders 18 holding the substrate simultaneously, and the arm raising/lowering mechanism 104 raises the arm 102. After transferring the substrate holders 18 to the stocker 24, the arm rotating mechanism 106 rotates the arm 102 by 90°, such that the substrate holders 18 are positioned vertically. The arm raising/lowering mechanism 104 lowers the arm 102, thereby suspending (temporary placement) the two substrate holders 18 in the stocker 24.

The above process performed by the substrate transferring device 22, the substrate loading/unloading unit 20, and the transporter 42 of the substrate holder transferring device 40 is repeated in order to load substrate W one after another into the substrate holder 18 accommodated in the stocker 24 and suspend (temporarily placement) the substrate holder 18 one after another at prescribed positions in the stocker 24.

When the sensor mounted on the substrate holder 18 for checking the contact state between the substrate and the contact points determines a poor contact, the sensor inputs the signal into a controller (not shown).

Meanwhile, the gripping mechanisms 108 of the other transporter 44 of the substrate transferring device 40 simultaneously grip two substrate holders 18 that have been holding the substrates and temporarily placed in the stocker 24. The arm raising/lowering mechanism 104 of the transporter 44 raises the arm 102 and the transporter 44 transfers the substrate holders 18 to the pre-wetting tank 26. The arm raising/lowering mechanism 104 lowers the arm 102, thereby immersing both the substrate holders 18 into pure water, for example, held in the pre-wetting tank 26. The pure water wets the surfaces of the substrates W to create a more hydrophilic surface. Obviously, an aqueous liquid other than pure water can be used, providing the liquid can improve the hydrophilic property of the substrate by wetting the surface of the substrate and replacing the bubbles in the holes with water.

However, if the sensor mounted on the substrate holder 18 for checking the contact state between the substrate and contact points has detected a poor contact state, the substrate holder 18 holding the substrate having the poor contact is left stored in the stocker 24. Accordingly, when a poor contact between a substrate and the contact points of the substrate holder 18 occurs, it does not halt the apparatus, but allows plating operations to continue. The substrate with a poor contact does not apply to the plating process. Instead the substrate is returned to the cassette and discharged from the cassette.

Next, the substrate holders 18 holding the substrates are transferred in the same way as described above to the pre-soaking tank 28 and the substrates are immersed into a chemical liquid such as sulfuric acid or hydrochloric acid held in the pre-soaking tank 28. The chemical liquid etches an oxide layer having a high electrical resistance that is formed on the surface of the seed layer and exposes a clean metal surface. Next, the substrate holders 18 holding the substrates are transferred in the same way to the cleaning tank 30*a*, wherein the surfaces of the substrates are cleaned by pure water held therein.

After the cleaning process, the substrate holders 18 holding the substrates are transferred in the same way as described above to the copper plating tank 34, which is filled with a plating liquid, and suspended in the plating units 38. The transporter 44 of the substrate holder transferring device 40 repeatedly performs this operation of transferring the substrate holder 18 to the plating unit 38 and suspending the substrate holder 18 at a prescribed position therein.

When all the substrate holders 18 are suspended in the plating units 38, plating liquid is supplied through the plating liquid supply pipes 206. While the plating liquid overflows into the overflow tank 36, plating voltages are applied between the anodes 200 and the substrates. At the same time, the paddle driving units 46 reciprocate the paddles 202 in a direction parallel to the surfaces of the substrates, thereby plating the surfaces of the substrates. At this time, each of the substrate holders 18 is fixed in a suspended state by the hands 76 at the top of the plating unit 38. Electricity is supplied from a plating power source to the seed layer on the substrate via the hand fixed portion, the hand, and the contact points.

The plating liquid is injected into the plating units 38 through the bottom thereof and overflows into the top of the walls around the plating units 38. The overflowed plating liquid is regulated in its concentration, and has foreign bodies removed by the filter before being reintroduced into the plating units 38 from the lower portion of the plating units 38. With this circulation process, the concentration of the plating liquid is maintained at a constant level. The plating liquid can be maintained at an even more uniform state by applying a dummy electrolytic voltage between the cathode 184 and the anode 186 for dummy plating.

After completion of the plating process, the application of plating voltages, supply of plating liquid, and reciprocation of the paddles are all stopped. The gripping mechanisms 108 of the transporter 44 of the substrate holder transferring device 40 grip two of the substrate holders 18 holding the substrates simultaneously, and transfer the substrate holders 18 to the cleaning tank 30*b*, as described above. The substrate holders 18 are immersed in pure water held in the cleaning tank 30*b* to clean the surfaces of the substrates W. Subsequently, the substrate holders 18 are transferred as described above to the blowing tank 32, where air is blown onto the substrate holders 18 holding the substrates to remove water droplets deposited thereon. Next, the substrate holders 18 are returned and suspended at prescribed positions in the stocker 24, as described above.

The above operation of the transporter 44 of the substrate holder transferring device 40 is repeatedly conducted. After each substrate W has applied to the complete plating process, the substrate holders 18 are returned to the prescribed suspended position in the stocker 24.

Meanwhile, the gripping mechanisms 108 of the transporter 42 of the substrate holder transferring device 40 simultaneously grip two of the substrate holders 18 holding the substrates that have been returned to the stocker 24 after the plating process, and place the substrate holders 18 on the loading plate 52 of the substrate loading/unloading unit 20, as described above. At this time, a substrate for which a poor connection was detected by the sensor mounted on the substrate holders 18 for checking contact state between the substrate and contact points and which was left in the stocker 24 is also transferred to the loading plate 52.

Next, the moveable supporting member 58 in the substrate holder 18 positioned at the center of the substrate loading/unloading unit 20 is unlocked by the locking/unlocking mechanism. The cylinder is operated to open the moveable supporting member 58. In this state, the substrate transferring device 22 takes the plating processed substrate out of the substrate holder 18 and transfers the substrate to the spin dryer 16. The spin dryer 16 spins the substrate at a high rotation speed for spin drying (draining). The substrate transferring device 22 then transfers the substrate back to the cassette 10.

After the substrate is returned to the cassette 10, or during this process, the loading plate 52 is slid laterally, and the same process is performed for the substrate mounted in the other substrate holder 18 so that the substrate is spin-dried and returned to the cassette 10.

The loading plate 52 is returned to its original position. Next, the gripping mechanisms 108 of the transporter 42 grip two substrate holders 18 which now contain no substrate, at the same time, and return the substrate holders 18, to the prescribed position in the stocker 24, as described above. Subsequently, the gripping mechanisms 108 of the transporter 42 of the substrate holder transferring device 40 grip two of the substrate holders 18 holding the substrates that have been returned to the stocker 24 after the plating process, and transfers the substrate holders 18 onto the loading plate 52, as described above. The same process is repeated.

Figure 29B:
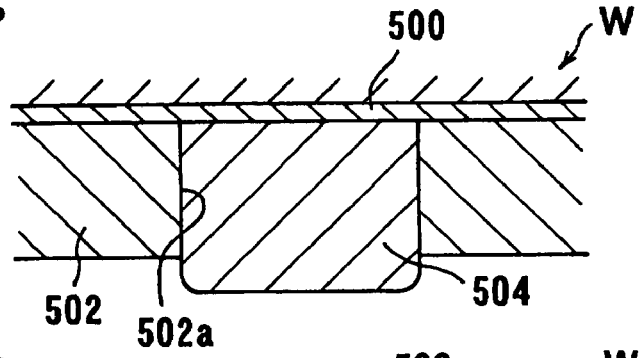
FIG. 29B PRIOR ART

The process is completed when all substrates have been taken out of the substrate holders, which have been holding substrates after the plating process and returned to the stocker 24, spin-dried and returned to the cassette 10. This process provides substrates W that have a plated film 504 grown in the opening 502*a* formed in the resist 502, as shown in FIG. 29B.

Figure 29C:
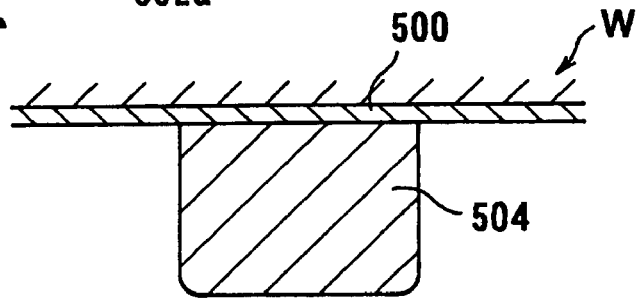
FIG. 29C PRIOR ART
Figure 29D:
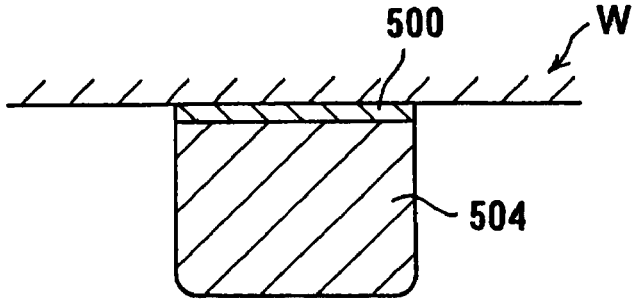
FIG. 29D PRIOR ART
Figure 29E:
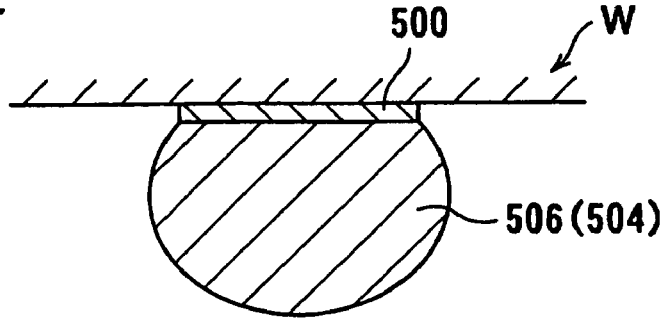
Figure 30:
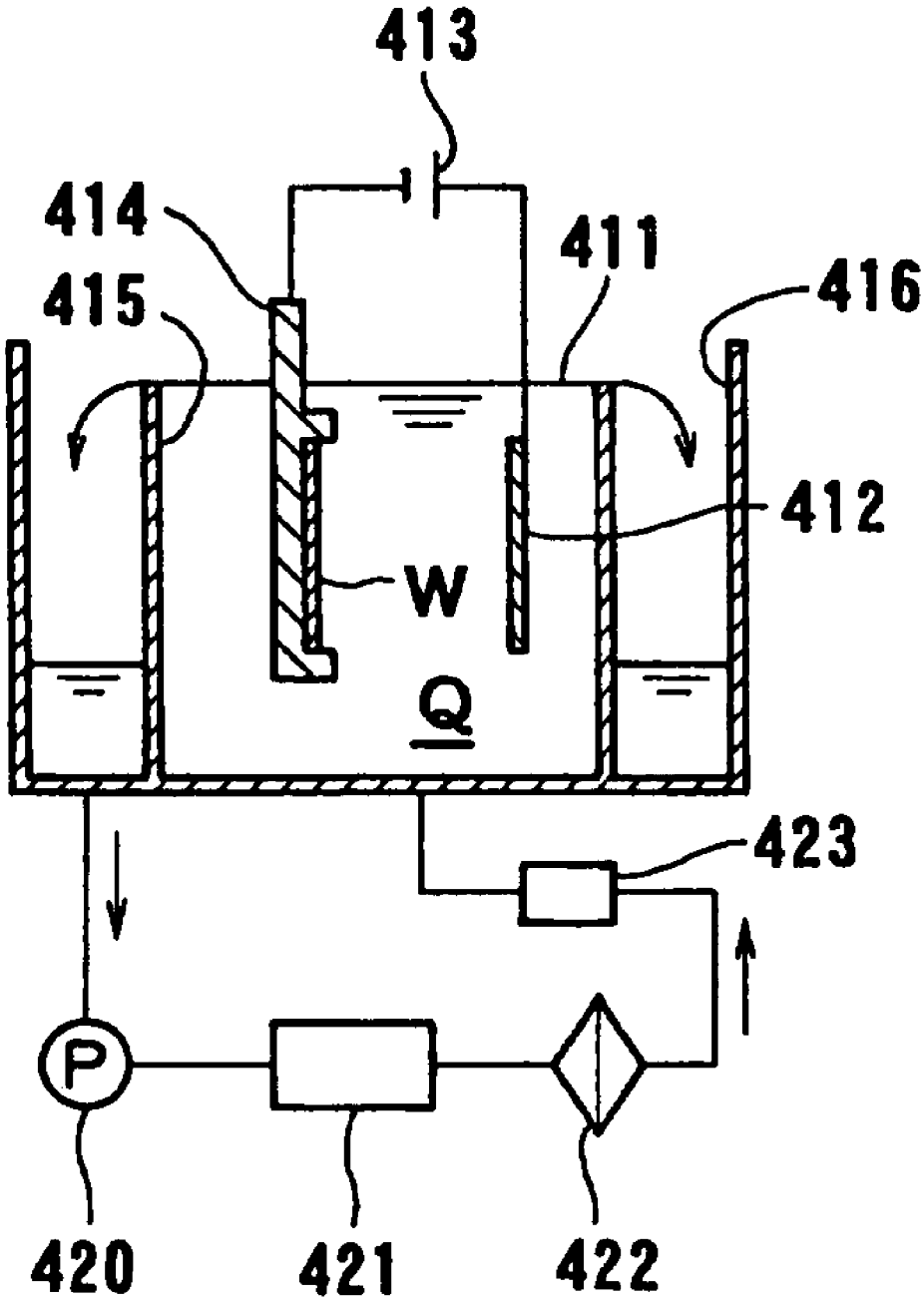
FIG. 30 PRIOR ART
FIG. 30 is schematic view of a conventional plating apparatus.

In a plating apparatus having a resist peeling unit 600, seed layer removing unit 602, and heating unit 604, as shown in FIG. 3B, the substrate W is spin dried, as described above, and transferred to the resist peeling unit 600. Here, the substrate W is immersed in a solvent, such as acetone, that is maintained at a temperature of 50-60° C., for example. In this process, the resist 502 is peeled off from the surface of the substrate W, as shown in FIG. 29C. Next, the substrate W is transferred to the seed layer removing unit 602 where the unnecessary seed layer 500 exposed after the plating process is removed, as shown in FIG. 29D. Next, the substrate W is transferred to the heating unit 604 comprising e.g. a diffusion furnace, and the plated film 504 is caused to reflow for thereby forming the bump 506 having a spherical shape due to surface tension as shown in FIG. 29E. Further, the substrate W is annealed at a temperature of, for example, 100° C. or higher, thereby removing residual stress in the bump 506. This annealing process helps to form an alloy in the bump 506 when forming a bump by multi-layer plating, as described below. After the annealing process, the substrate W is returned to the cassette 10 to complete the process.

Further, as shown in FIG. 3C, in the plating apparatus having a reflowing unit 606 and an annealing unit 608 in place of the heating unit 604, the plated film 504 is caused to reflow in the reflowing unit 606, and then the substrate is transferred to the annealing unit 608 and annealed therein.

In this example, the stocker 24 for accommodating the substrate holders 18 in a vertical position is provided between the substrate loading/unloading unit 20 and plating units 38. The first transporter 42 of the substrate holder transferring device 40 transfers the substrate holders 18 between the substrate loading/unloading unit 20 and stocker 24, and the second transporter 44 of the substrate holder transferring device 40 transfers the substrate holders 18 between the stocker 24 and plating units 38, respectively. Unused substrate holders 18 are stored in the stocker 24. This is designed to improve throughput by providing smooth transferring of the substrate holders 18 on either side of the stocker 24. However, it is of course possible to use one transporter to perform all transferring operations.

Further, a robot having a dry hand and a wet hand may be employed as the substrate transferring device 22. The wet hand is used only when taking out plating-processed substrates from the substrate holders 18. The dry hand is used for all other operations. In principle, the wet hand is not necessarily required since the backside of the substrate does not contact with plating liquid due to the seal of the substrate holder 18. However, by using the two hands in this manner, it is possible to prevent a possible contamination with a plating liquid due to poor sealing or transferring to the backside of a rinse water, etc. from contaminating the backside of a new substrate.

Further, a bar code may be attached to the cassette 10. By inputting information such as the usage state of the substrate holder 18 such as storage position of the substrate holder 18 in the stocker 24, the relationship between the cassette 10 and the substrate W housed in the cassette 10, or the relationship between the substrate holder 18 and the substrate W taken out of the substrate holder 18 from a control panel or the like, the substrate taken out of the cassette 10 before a plating process can be returned to the same cassette 10 after the plating process, and the processing state of the substrate W and the state of the substrate holder 18 can be monitored. Alternatively, by attaching a bar code to the substrate, the substrate itself may be managed.

Figure 22A:
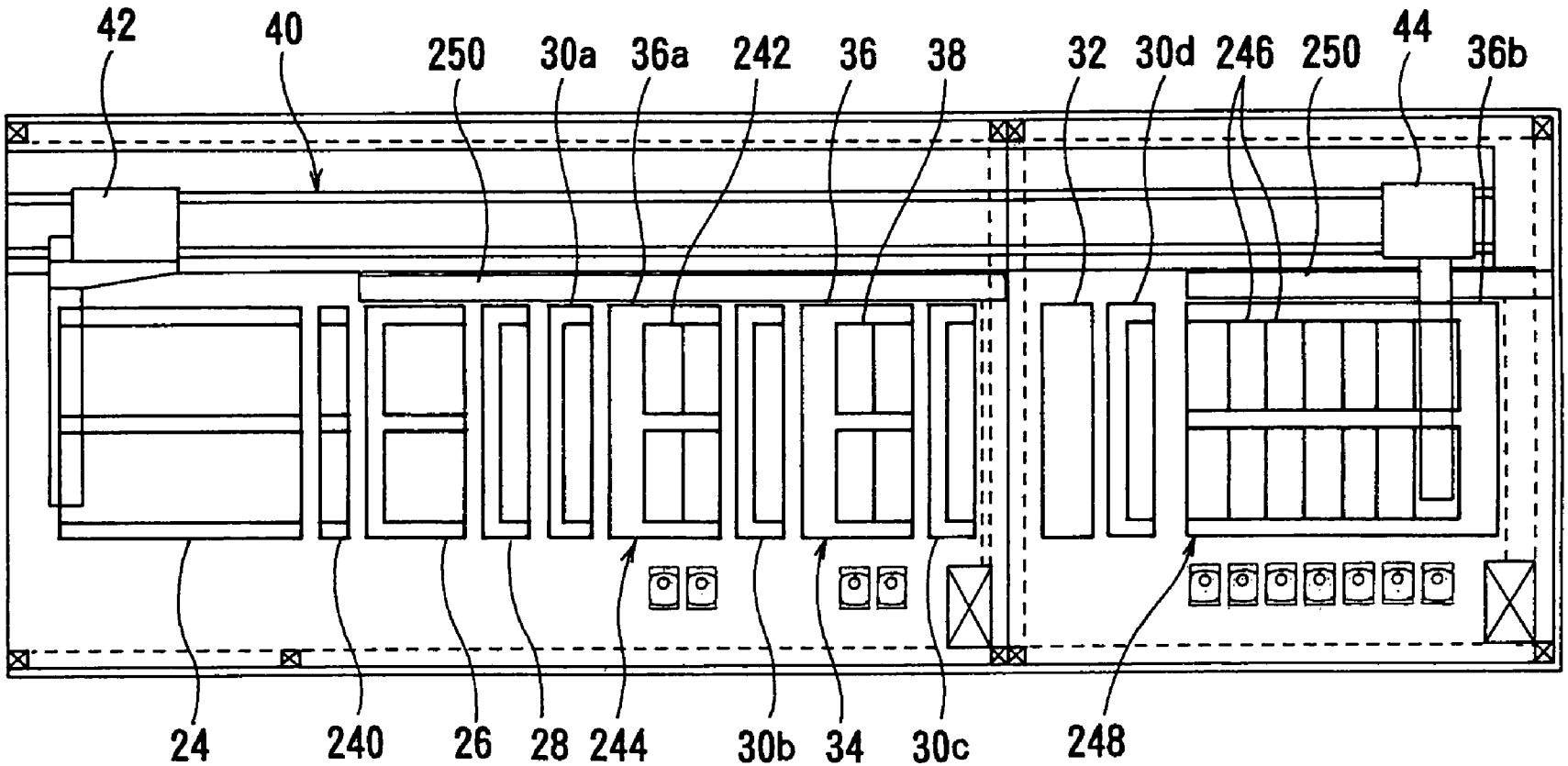
FIG. 22A is a plan view of a plating section of a plating apparatus according to a fourth embodiment of the present invention.
Figure 23:
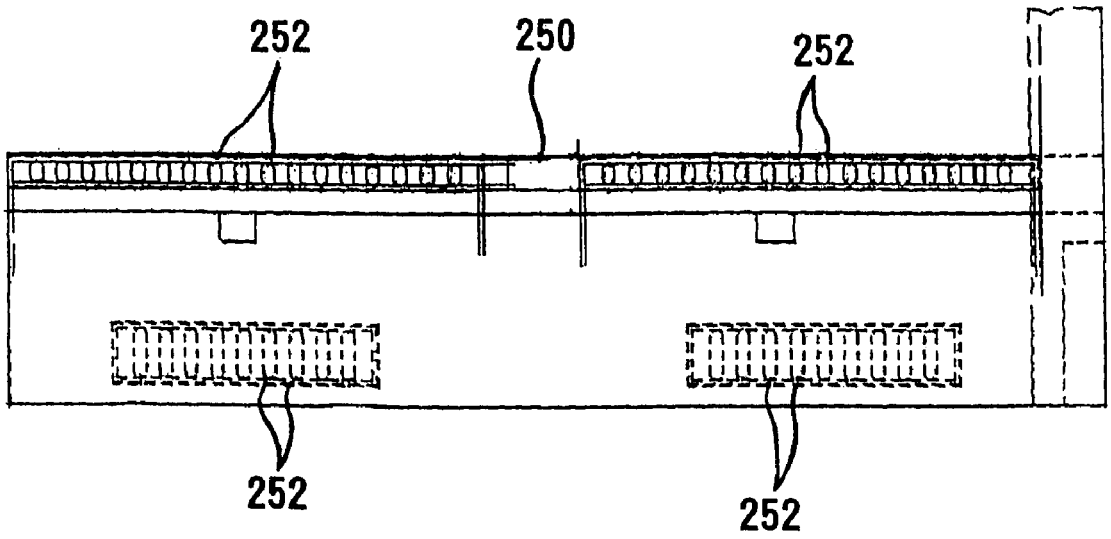
FIG. 23 is a diagram showing a local exhaust duct and duct holes connected to the local exhaust duct.

FIGS. 22A and 23 show a plating apparatus according to a fourth embodiment of the present invention. This apparatus is provided with plating tanks for performing different types of plating processes and adapted to various processes freely.

FIG. 22A shows a plating section provided with plating tanks for performing various types of plating processes. The plating section includes the stocker 24; a temporary storing platform 240; the pre-wetting tank 26; the pre-soaking tank 28; the first cleaning tank 30*a*; a nickel plating tank 244 having an overflow tank 36*a* and a plurality of nickel plating units 242 disposed in the overflow tank 36*a* for performing nickel plating on the surface of a substrate; the second cleaning tank 30*b*; the copper plating tank 34 having the overflow tank 36 and a plurality of the copper plating units 38 disposed in the overflow tank 36 for performing copper plating on the surface of a substrate; the third cleaning tank 30*c*; the blowing tank 32; the fourth cleaning tank 30*d*; and a solder plating tank 248 having an overflow tank 36*b* and a plurality of solder plating units 246 disposed in the overflow tank 36*b* for performing solder plating on the surface of a substrate.

The constructions of the nickel plating units 242 and the solder plating units 246 are essentially the same as that of the copper plating units 38. Further, the constructions of the nickel plating tank 244 and solder plating tank 248 accommodating the respective units in the respective overflow tanks have essentially the same construction as the copper plating tank 34. All other constructions are the same as these described in the first embodiment.

In this embodiment, the substrate mounted in the substrate holder 18 applied to nickel plating, copper plating, and solder plating in order on its surface. Thus, this apparatus can perform a series of operations to form bump electrodes and the like with multiple plating: nickel, copper, and solder.

Figure 22B:
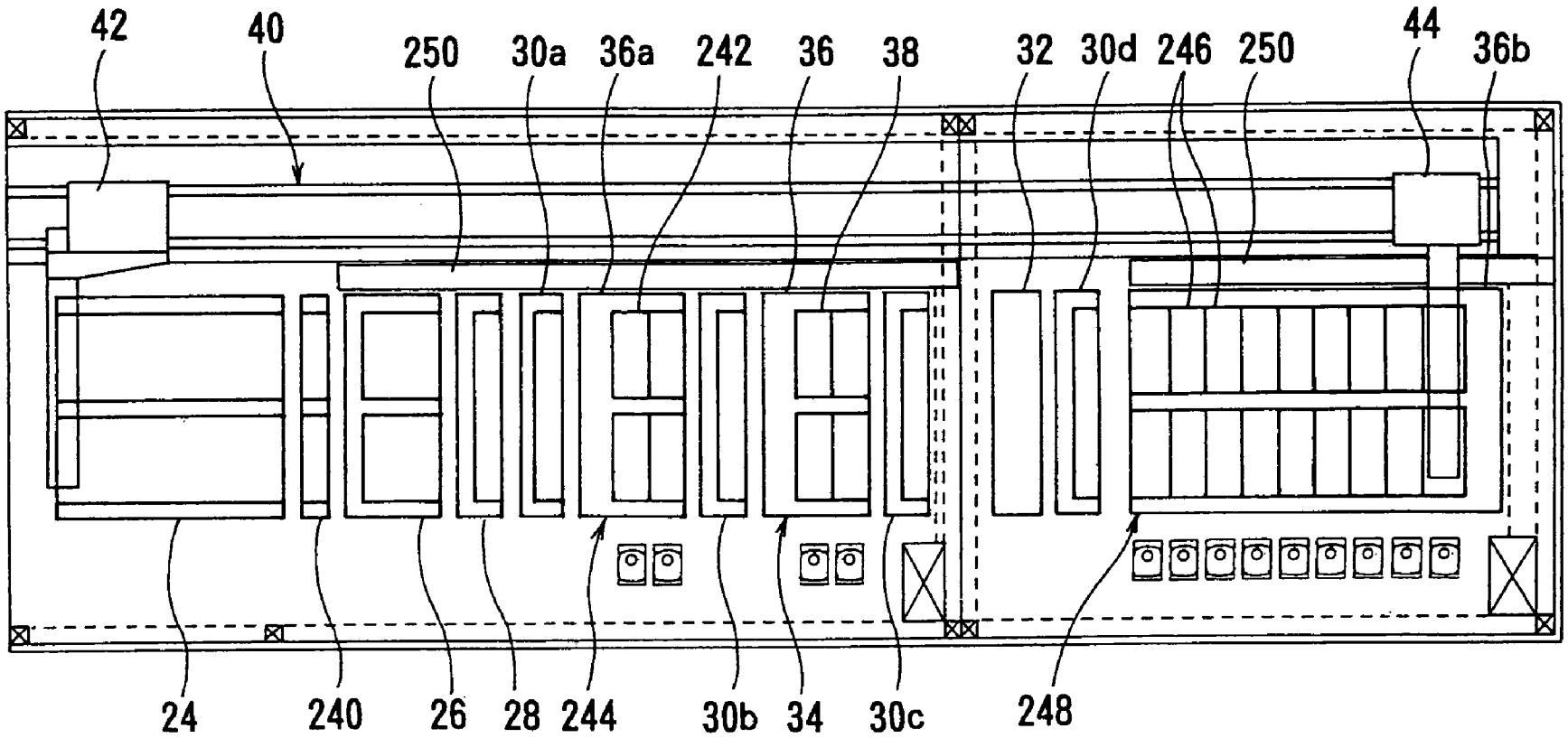
FIG. 22B is a variation of the plating section of FIG. 22A.

In this example, the plating apparatus includes four nickel plating units 242, four copper plating units 38, and fourteen solder plating units 246 (22 plating units in total). However, as shown in FIG. 22B, for example, the apparatus can comprise four nickel plating units 242, four copper plating units 38, and eighteen solder plating units 246 (26 plating units in total). Of course, the number of each type of plating units can be set arbitrarily. Also, the kind of metal to be plated in each unit can also be varied.

In addition to the Ni—Cu-solder multi-layer bumps, other types of multi-layer bumps that can be formed include Cu—Au-solder, Cu—Ni-solder, Cu—Ni—Au, Cu—Sn, Cu—Pd, Cu—Ni—Pd—Au, Cu—Ni—Pd, Ni-solder, and Ni—Au etc. The type of solder used here can be either a high melting point solder or a eutectic solder.

Further, bumps composed of multi-layers of Sn—Ag or Sn—Ag—Cu can be formed as alloys by performing the annealing process described above. Unlike the conventional Sn—Pb solder, Pb-free solder resolves the environmental problem of generating alpha rays.

In this embodiment, a local exhaust duct 250 is disposed alongside the substrate holder transferring device 40 and parallel therewith, as shown in FIG. 23, and a plurality of duct holes 252 are formed in communication with the local exhaust duct 250. The duct holes 252 are designed to suck air toward the local exhaust duct 250 to generate an air flow in a single direction from the bottom of each plating tank toward the ceiling. With this configuration, a vapor emitted from each plating tank is carried by this air flow in a single direction toward the local exhaust duct 250, thereby preventing the vapor from contaminating the substrate, etc.

According to the plating apparatus in this embodiment, by loading cassettes housing substrates onto the cassette table and starting the apparatus, it is possible to completely automate the electrolytic plating process by the dipping method to automatically form an appropriate plated metal layer for bump electrodes and the like on the surfaces of the substrates.

In this embodiments described above, the substrate holder holds the substrate while sealing the peripheral edges and backside thereof. The substrate and substrate holder are transferred together to apply to each process. However, the substrates can also be accommodated in a rack-like transferring device for transferring the substrates. In this case, a thermally oxidized layer (Si oxide layer), an adhesive tape film, or the like can be applied to the backside of the substrates to prevent the same from being plated.

Further according to the embodiments described above, the automatic electrolytic plating process using the dipping method is performed to form bumps on the substrate. However, such bumps can also be formed by a fully automated electrolytic plating process of a jet type or cup type in which a plating liquid is spurted from below.

Figure 24:
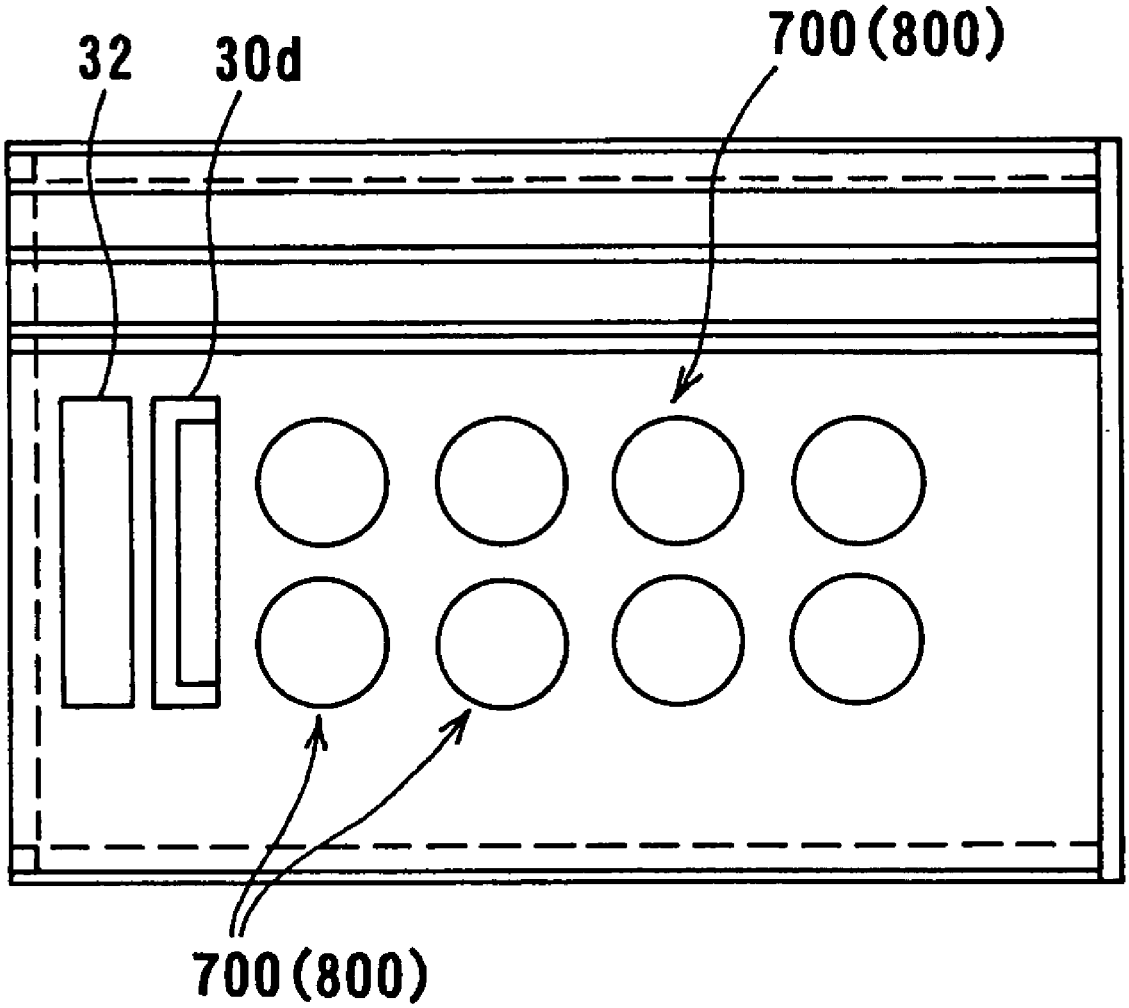
FIG. 24 is a plan view of a plating section of a plating apparatus according to a fifth embodiment of the present invention.

FIG. 24 shows the main portion of the plating section of a plating apparatus according to a fifth embodiment. Here, a plating section including a plurality of jet or cup type plating units 700 are arranged downstream of the cleaning tank 30*d* shown in FIG. 22A, for example. The plating units 700 perform a plating process such as copper plating.

Figure 25:
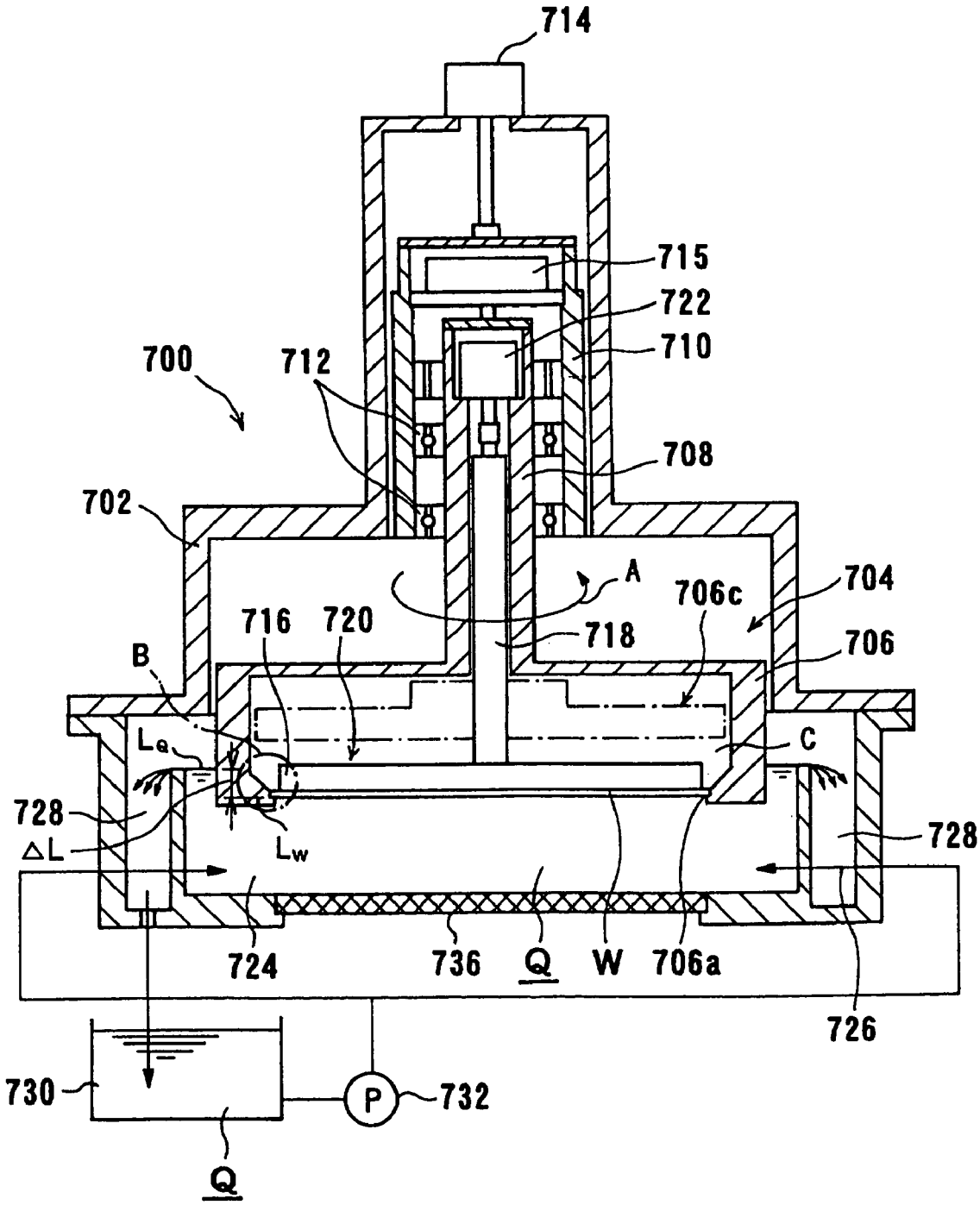
FIG. 25 is a cross-sectional view of a plating unit for use in the plating section of FIG. 24.

FIG. 25 shows the plating unit 700 shown in FIG. 24. The plating unit 700 has a plating tank body 702 which houses therein a substrate holder 704 for holding a substrate W. The substrate holder 704 has a substrate holding case 706 and a rotatable shaft 708 that is rotatably supported by an inner surface of cylindrical guide member 710 through bearings 712, 712. The guide member 710 and the substrate holder 704 are vertically movable with a predetermined stroke by a cylinder 714 provided at the top of the plating tank body 702.

The substrate holder 704 is allowed to rotate in the direction of arrow A through the rotating shaft 708 by a motor 715 provided at an upper position in the guide member 710. The substrate holder 704 has a space C therein which accommodates a substrate presser 720 that comprises a substrate presser plate 716 and a substrate presser shaft 718. The substrate presser 720 is vertically movable with a predetermined stroke by a cylinder 722 provided at an upper position within the shaft 708.

The substrate holding case 706 of the substrate holder 704 has a bottom opening 706*a* which communicates with the space C. The substrate holding case 706 has a step extending around an upper portion of the bottom opening 706*a* for placing the outer circumferential edge of the substrate W thereon. When the outer circumferential edge of the substrate W is placed on the step and the upper surface of the substrate W is pressed by the substrate presser plate 716, the outer circumferential edge of the substrate W is sandwiched between the substrate presser plate 716 and the step. The lower surface (plating surface) of the substrate W is exposed in the bottom opening 706*a*.

A plating chamber 724 is disposed below the substrate holder 704 in the plating tank body 702, i.e., below the plating surface of the substrate W that is exposed in the lower opening 706*a*. A plating liquid Q is ejected from a plurality of plating liquid injection pipes 726 toward the center of the plating chamber 724. The plating chamber 724 is surrounded by a collecting gutter 728 for collecting the plating liquid Q that has overflowed the plating chamber 724.

The plating liquid Q collected in the collecting gutter 728 is returned to a plating liquid storage tank 730. The plating liquid Q in the plating liquid storage tank 730 is delivered by a pump 732 horizontally from outwardly of the plating chamber 724 therein. The plating liquid Q thus introduced into the plating chamber 724 is turned into a uniform vertical flow toward the plating surface of the substrate W when the substrate W is rotated and contacts with the surface of the substrate. The plating liquid Q that has overflowed the plating chamber 724 is collected in the collecting gutter 728, from which the plating liquid Q flows into the plating liquid storage tank 730. The plating liquid Q thus circulates between the plating chamber 724 and the plating liquid storage tank 730.

The level $L_Q$ of the plating liquid in the plating chamber 724 is higher than the level $L_W$ of the plating surface of the substrate W by a small distance ΔL. Therefore, the entire plating surface of the substrate W is contacted with the plating liquid Q.

Electrical contacts for electrically continuing with the conductor portion of the substrate W are provided in the step of the substrate holding case 706. The electrical contacts are connected to the negative electrode of an external plating power source (not shown) through a brush. An anode plate 736 connected to the positive electrode of the plating power (not shown) source is provided in the bottom of the plating chamber 724 facing to the substrate W. The substrate holding case 706 has a substrate takeout opening 706*c* defined in the sidewall thereof for inserting into and taking out the substrate therethrough by a substrate loading and unloading member such as a robot arm.

The plating unit 700 operates as follows: the cylinder 714 is operated to lift the substrate holder 704 together with the guide member 710 by a predetermined distance, and the cylinder 722 is operated to lift the substrate presser 720 by a predetermined distance to a position where the substrate presser plate 716 is located above the substrate takeout opening 706*c*. The substrate loading and unloading member such as a robot arm is then actuated to introduce the substrate W through the opening 706*c* into the space C in the substrate holder 704, and place the substrate W on the step such that the plating surface of the substrate W faces downward. The cylinder 722 is operated to lower the substrate presser plate 716 until its lower surface touches the upper surface of the substrate W, thereby sandwiching the outer circumferential edge of the substrate W between the substrate presser plate 716 and the step.

The cylinder 714 is operated to lower the substrate holder 704 together with the guide member 710 until the plating surface of the substrate W contacts the plating liquid Q (i.e. to the position that is lower than the level $L_Q$ of the plating liquid Q by the distance ΔL). At this time, the motor 715 is energized to rotate the substrate holder 704 and the substrate W at a low speed while they are being lowered. The plating chamber 724 is filled with the plating liquid Q. When a predetermined voltage is applied between the anode plate 736 and the electric contacts from the plating power source, a plating electric current flows from the anode plate 736 to the substrate W, forming a plated film on the plating surface of the substrate W.

During the plating process, the motor 715 is continuously energized to rotate the substrate holder 704 and the substrate W at a low speed. The speed is selected so as to form a plated film of uniform thickness on the plating surface of the substrate W without disturbing the vertical flow of the plating liquid in the plating chamber 724.

After the plating process is finished, the cylinder 714 is operated to lift the substrate holder 704 and the substrate W. When the lower surface of the substrate holding case 706 reaches a position higher than the level $L_Q$ of the plating liquid, the motor 715 is energized to rotate at a higher speed to drain off the plating liquid from the plated surface of the substrate W and from the lower surface of the substrate holding case 706 by the action of centrifugal force. Thereafter, the cylinder 722 is operated to lift the substrate presser plate 716 to release the substrate W, which remains placed on the step of the substrate holding case 706. Then, the substrate loading and unloading member such as a robot arm is introduced through the substrate takeout opening 706*c* into the space C in the substrate holder 704, holds the substrate W, and carries the substrate W through the opening 706*c* out of the substrate holder 704.

The above example employs the face-down method of plating with the plating unit 700. However, it is also possible to employ a face-up type plating process, as shown in FIG. 26.

Figure 26:
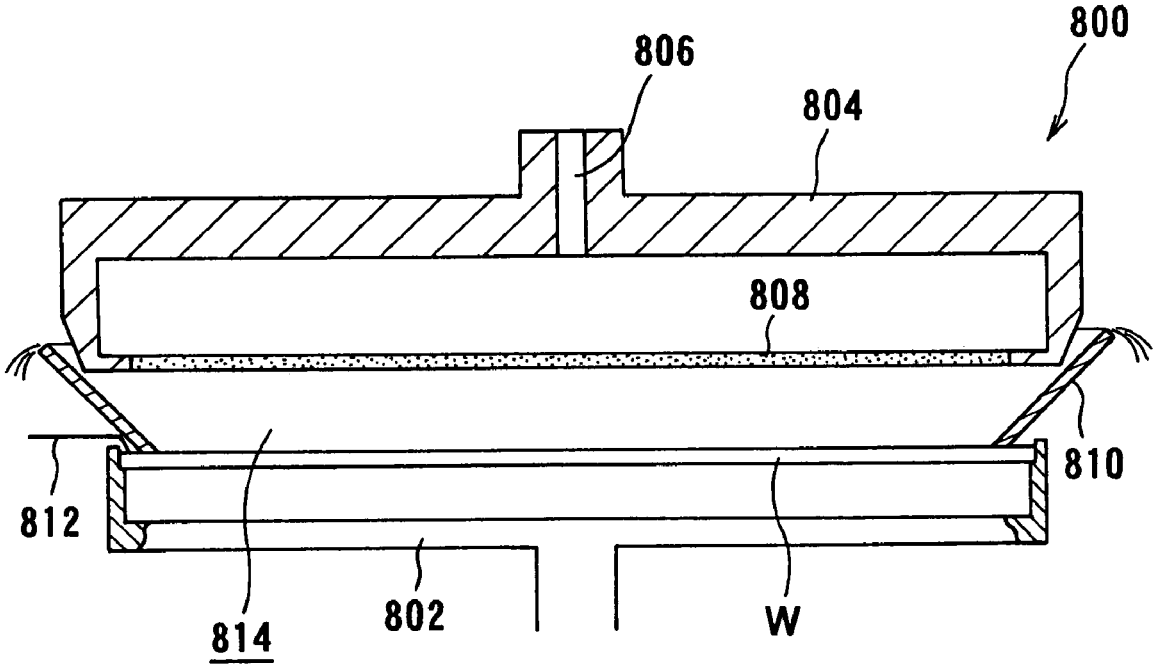
FIG. 26 is a cross-sectional view of another plating unit for use in the plating section of FIG. 24.

FIG. 26 shows an example of a plating unit 800 to perform a face-up plating process. The plating unit 800 is provided with a substrate holder 802 capable of moving up and down that holds the substrate W with the surface to be plated facing upward and an electrode head 804 positioned above the substrate holder 802. The electrode head 804 is in a cup shape with an open bottom and provided with a plating liquid supply inlet 806 at the upper surface which is connected to a plating liquid supply tube (not shown) and an anode 808 disposed at the bottom opening of the electrode head 804 and formed of, for example, a porous material or of a plate having a plurality of through-holes.

A substantially cylindrical sealing member 810 is provided below the electrode head 804. The top of the sealing member 810 surrounds the lower periphery of the electrode head 804, while the diameter of the cylinder decreases toward the bottom. A plurality of electrical contact points 812 are disposed outside of the sealing member 810. When the substrate holder 802 holding the substrate is raised, the edge portion of the substrate W contacts the sealing member 810, forming a plating chamber 814 between the sealing member 810 and the substrate W. At the same time, the edge portion of the substrate W contacts the electrical contact points 812 outside the contacting portion with the sealing member 810, making the substrate W function as a cathode.

In this embodiment, the substrate holder 802 holding a substrate W is raised to make the edge portion of the substrate W contact the sealing material 810, thereby forming the plating chamber 814 and allowing the substrate W to function as a cathode. In this state, a plating liquid is supplied into the electrode head 804 via the supply inlet 806 of the electrode head 804 and introduced through the anode 808 into the plating chamber 814, thereby immersing the anode 808 and the surface of the substrate W, serving as the cathode, in the plating liquid. Next, the plating process can be performed on the surface of the substrate W by applying a prescribed voltage from a plating power source between the anode 808 and the substrate W.

Figure 27:
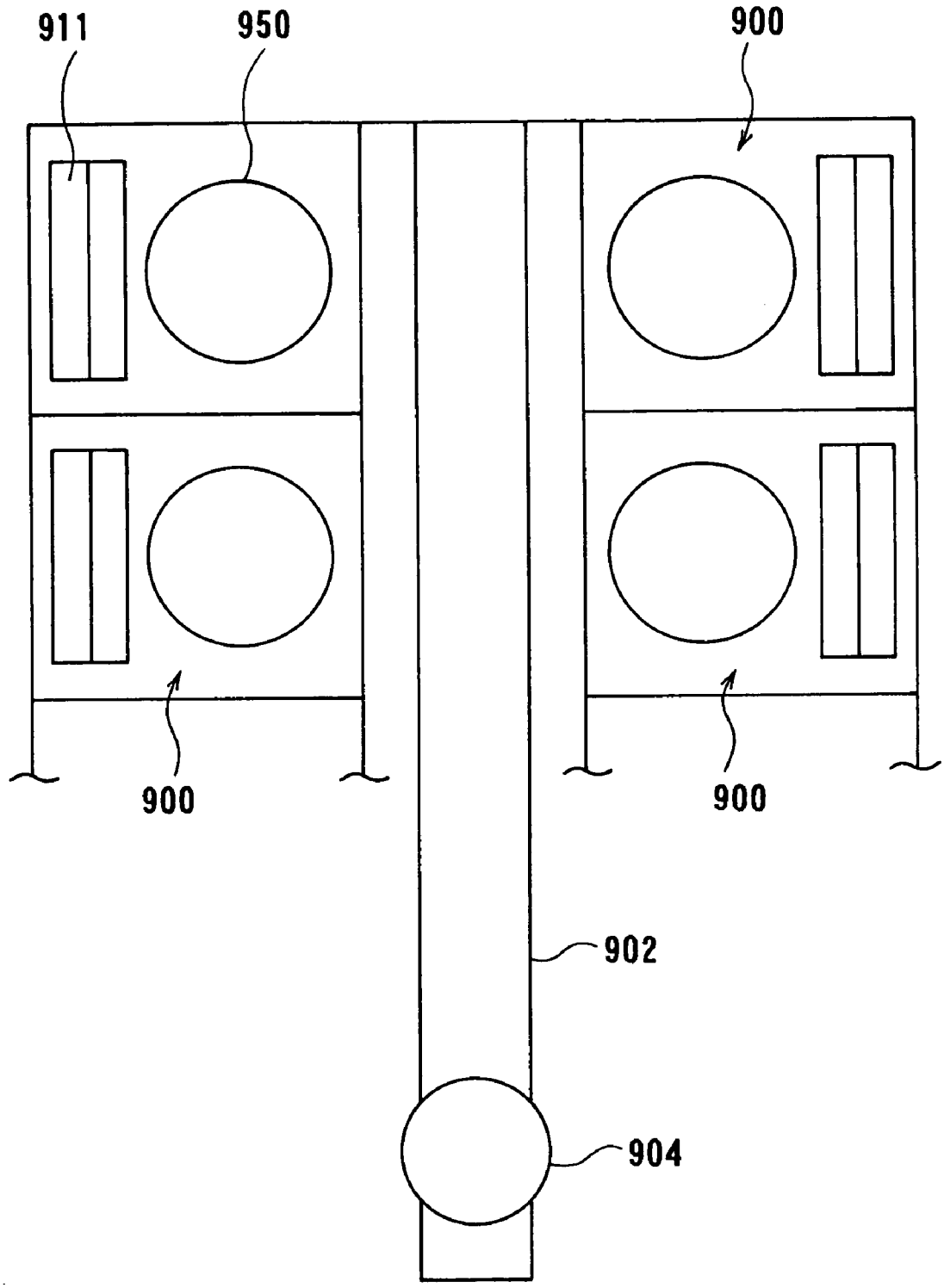
FIG. 27 is a plan view of a plating section of a plating apparatus according to a sixth embodiment of the present invention.

FIG. 27 shows the main portion of the plating section of a plating apparatus according to a sixth embodiment of the present invention. The plating section of this plating apparatus includes a plurality of plating units 900 which are capable of opening and closing, and arranged downstream of the cleaning tank 30*d* shown in FIG. 24, for example, and on two sides. A substrate transferring device 904 comprising a robot or the like can move along the central transferring path 902. In this embodiment, a substrate W is transferred between a substrate holding table 950 housed in the plating unit 900 and the substrate transferring device 904. After the substrate holding table 950 receives a substrate W from the substrate transferring device 904, the plating unit 900 performs a plating process on the surface of the substrate W.

Figure 28:
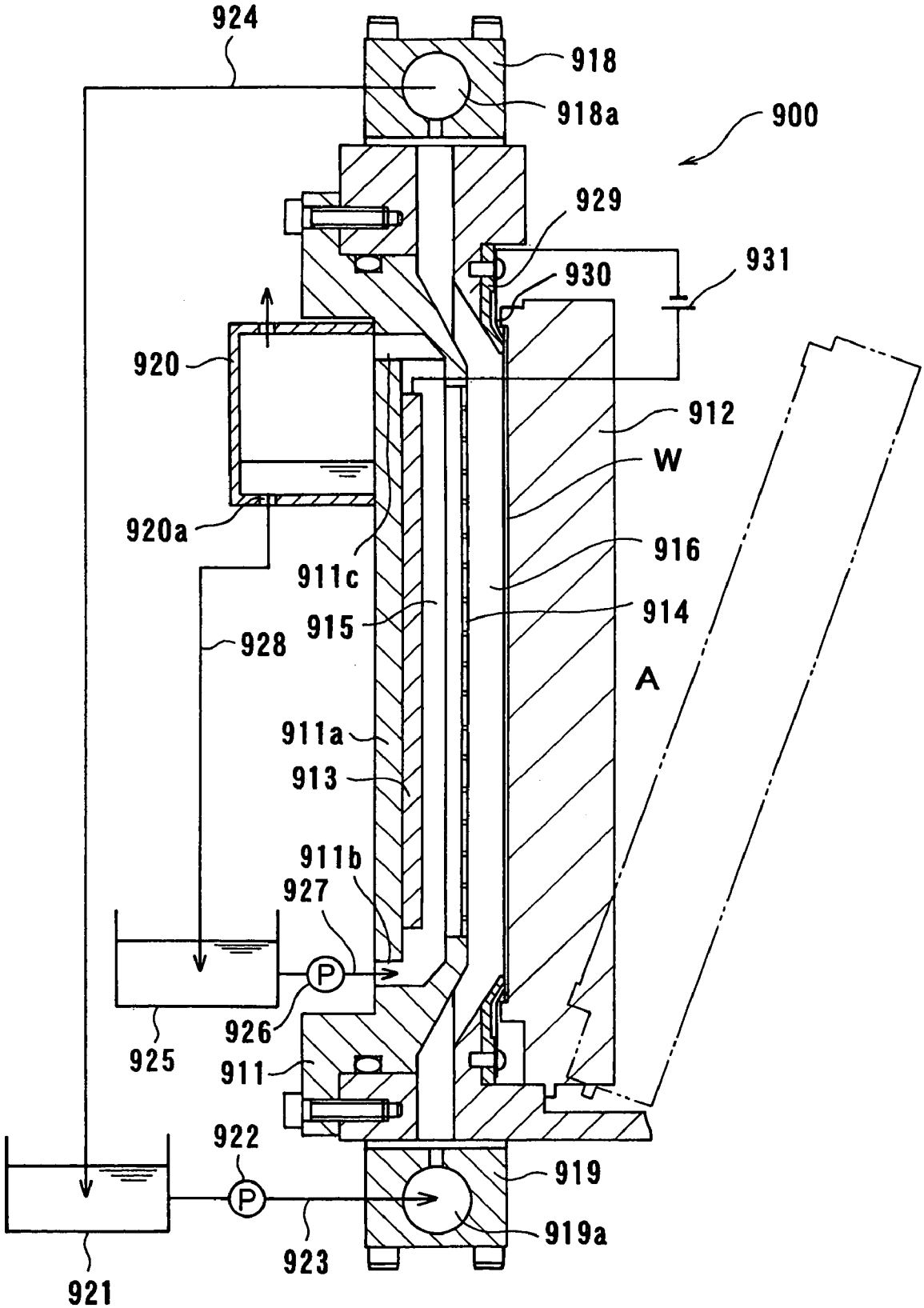
FIG. 28 is a cross-sectional view of a plating unit for use in the plating section of FIG. 27.

FIG. 28 shows an example of the plating unit 900 shown in FIG. 27. The plating unit 900 is provided with a plating tank body 911 and a side plate 912. The side plate 912 is disposed facing to the plating tank body 911, and a depression A is formed in the surface of the plating tank body 911 facing the side plate 912. By a hinge mechanism disposed at the bottom of the side plate 912, the side plate 912 can open and close the depression A formed in the plating tank body 911.

An insoluble anode plate 913 is disposed on a bottom surface of a bottom member 911*a* of the plating tank body 911 at the depression A. The substrate W is mounted on the surface of the side plate 912 facing the plating tank body 911.

With this construction, when the side plate 912 is closed over the depression A of the plating tank body 911, the anode plate 913 and substrate W come to be positioned facing each other at a prescribed distance. A neutral porous diaphragm or a cation exchange membrane 914 is mounted on the plating tank body 911 and positioned between the anode plate 913 and the substrate W. The neutral porous diaphragm or cation exchange membrane 914 divides the depression A in the plating tank body 911 into an anode chamber 915 and a cathode chamber 916.

A top header 918 and a bottom header 919 are provided on the top and bottom of the plating tank body 911, respectively. A cavity 918*a* of the top header 918 and a cavity 919*a* of the bottom header 919 are in communication with the cathode chamber 916, respectively. An inlet 911*b* communicating with the anode chamber 915 is provided at the bottom thereof, and an overflow outlet 911*c* communicating with the anode chamber 915 is provided at the top thereof. An overflow chamber 920 is provided adjacent to the overflow outlet 911*c* and at the side of the plating tank body 911.

A plating liquid held in a plating liquid tank 921 is supplied by a pump 922 to the cavity 919*a* of the bottom header 919 through a pipe 923, fills the cathode chamber 916, passes the cavity 918*a* at the top of the plating tank body 911, and returns to the plating liquid tank 921 through a pipe 924. An plating liquid held in an anode solution tank 925 is supplied by a pump 926 to the anode chamber 915 through a pipe 927, fills the anode chamber 915, overflows the overflow outlet 911*c* and flows into the overflow chamber 920. After being stored temporarily in the overflow chamber 920, the plating liquid is returned to the anode solution tank 925 through a discharge outlet 920*a* and a pipe 928.

Here, the cathode chamber 916 is hermetically sealed, while the top of the anode chamber 915 is open to the air.

An annular packing 929 is provided around the outer periphery of the depression A formed in the plating tank body 911. When the side plate 912 closes the depression A, the annular packing 929 contacts the peripheral surface of the substrate W to hermetically seal the cathode chamber 916. An external anode terminals 930 are provided outside of the annular packing 929. When the side plate 912 closes the depression A, the end of the external anode terminals 930 contact the conducting portion of the substrate W, thereby conducting electricity to the substrate W. Further, the annular packing 929 prevents the external anode terminals 930 from contacting the plating liquid. A plating power source 931 is connected between the anode terminals 930 and external anode plate 913.

In the plating unit 900 described above, the plating liquid is filled into and circulated to the cathode chamber 916, while another plating liquid is filled into and, while being left overflowing, circulated to the anode chamber 915. A plated film is formed on the surface of the substrate W by supplying an electric current from the plating power source 931 between the insoluble anode plate 913 and the substrate W, serving as a cathode.

In this embodiment, the anode chamber 915 and the cathode chamber 916 are partitioned, and the plating liquid is separately introduced in the respective chambers. However, the anode chamber 915 and the cathode chamber 916 may be integrated into a single chamber without providing a neutral membrane or a cation exchange membrane. Further, as the anode plate 913, a soluble anode plate may also be used.

Further, in another embodiment, the substrate holding table 950 in the plating unit 900 may serve also as the side plate 912. In this case, the substrate holding table 950 which has received the substrate W from the substrate transferring device 904 can move to close the depression A of the plating tank body 911. The remaining construction of the substrate holding table 950 is the same as in the above embodiment.

What is claimed is:

1. A plating apparatus, comprising:

a cassette table for loading a cassette housing a substrate therein;

a substrate holder for holding the substrate such that the front surface of the substrate is exposed while the back side and the edge thereof are hermetically sealed;

a substrate loading/unloading unit that is structured to support said substrate holder for loading and unloading of the substrate to and from said substrate holder;

a substrate transferring device for transferring the substrate between said cassette table and said substrate loading/unloading unit;

wherein said substrate loading/unloading unit is located at a position in said plating apparatus within a transfer movement range of said substrate transferring device so that said substrate transferring device can transfer the substrate to and from said substrate holder supported on said substrate loading/unloading unit;

a plating tank for accommodating said substrate holder while the substrate is vertically held by said substrate holder and plating the surface of the substrate while facing toward an anode; and a substrate holder transferring device having a transporter that grips the substrate holder, is vertically moveable, and transfers said substrate holder, said substrate holder transferring device being movable to and from said position of said substrate loading/unloading unit to transfer said substrate holder to and from said substrate loading/unloading unit.

2. The plating apparatus according to claim 1, wherein said plating tank includes a plurality of plating units, and each of said plating units is provided with a paddle that is disposed between said anode and the substrate which reciprocates to agitate a plating liquid.

3. The plating apparatus according to claim 1, wherein a paddle drive device for driving a paddle is provided on the opposite side of said substrate holder transferring device with respect to said plating tank.

4. The plating apparatus according to claim 1, wherein at least part of said substrate holder transferring device transfers the substrate holder with a linear motor.

5. The plating apparatus according to claim 1, wherein said plating tank includes a plurality of plating units, and a regulation plate is disposed between the substrate, serving as a cathode, and said anode facing to the substrate, in each of said plating units.

6. The plating apparatus according to claim 1, further comprising a sensor for checking the contact state between the substrate and electrical contact points for supplying current to the substrate to make the substrate a cathode.

7. The plating apparatus according to claim 1, further comprising an annealing unit for annealing a plated substrate.

8. The plating apparatus according to claim 1, further comprising a deaerating device for deaerating a plating liquid in said plating tank.

9. The plating apparatus according to claim 1, further comprising a plating liquid regulating device for analyzing components of plating liquid and adding components to the plating liquid based on the results of the analysis.

10. The plating apparatus according to claim 9, wherein said plating liquid regulating device adds components to the plating liquid by both a feedforward control method and a feedback control method.

11. The plating apparatus according to claim 1, further comprising a pre-wetting tank for applying pre-wetting treatments to the substrate to increase the wettability thereof.

12. The plating apparatus according to claim 11, further comprising a deaerating device for deaerating a pre-wetting liquid in said pre-wetting tank.

13. The plating apparatus according to claim 12, wherein said pre-wetting liquid is pure water.

14. The plating apparatus according to claim 1, further comprising a drying device, comprised of a blow tank, for drying the substrate holder.

15. The plating apparatus according to claim 1, further comprising a drying device, comprised of a spin dryer, for drying the substrate.

16. The plating apparatus according to claim 1, comprising further plating tanks for performing different types of plating, wherein each of said further plating tanks comprises an overflow tank and plating units for performing each type of plating, said plating units being accommodated in said overflow tank.

17. The plating apparatus according to claim 1, wherein a stocker for storing said substrate holder in a vertical position is provided between said substrate loading/unloading unit and said plating tank; and said substrate holder transferring device has a first transporter for transporting the substrate holder between said substrate loading/unloading unit and said stocker, and a second transporter for transporting the substrate holder between said stocker and said plating tank.

18. The plating apparatus according to claim 17, further comprising a pre-wetting tank, a blowing tank, and a cleaning tank that are disposed between said stocker and said plating tank in order going away from said stocker and along the side of said substrate loading/unloading unit.

19. The plating apparatus according to claim 1, wherein said substrate loading/unloading unit is constructed to support two substrate holders side by side that are slidable in a horizontal cross direction so that each substrate holder can individually hold a substrate.

20. The plating apparatus according to claim 1, wherein said substrate holder is operable to hold the substrate during plating, cleaning and drying processes.

21. The plating apparatus according to claim 1, further comprising a drying unit for drying the plated substrate after being taken out of said substrate holder.

22. The plating apparatus according to claim 17, wherein said substrate loading/unloading unit is provided with a sensor for checking a contact state between the substrate and contact points when the substrate is loaded into said substrate holder, and said second transporter selectively transfers only such substrate that has good contact with the contact points to a subsequent process.

23. The plating apparatus according to claim 1, further comprising a clean unit for cleaning a plated substrate after being taken out of said substrate holder.

24. The plating apparatus according to claim 5, wherein said regulation plate has a hole so as to be operable to lower electrical potential around the periphery of the substrate during plating.

25. The plating apparatus according to claim 5, further comprising an agitating paddle in each of said plating units movable in a direction parallel to the substrate.

26. The plating apparatus according to claim 1, wherein a locking/unlocking mechanism operable to lock said substrate holder with said substrate holder holding the substrate prior to plating, and operable to unlock said substrate holder for removal of the substrate after plating.

27. The plating apparatus of claim 26, wherein said substrate holder comprises a clamp ring that is rotatable to be locked and unlocked, said clamp ring having holes therein, and said locking/unlocking mechanism comprises pins for engagement with said holes.

28. The plating apparatus according to claim 1, wherein said substrate holder comprises a first supporting member and a second supporting member movable with respect to said first supporting member capable of opening to receive the substrate and closing to hold the substrate, said substrate holder comprising electrical contacts operable to supply electricity to the substrate when said first supporting member and said second supporting member are closed and hold the substrate.

29. The plating apparatus of claim 28, wherein said electrical contacts comprise a conductor on said first supporting portion and a metal contact on said second supporting portion for engaging the substrate, said conductor and said metal contact forming a connection when said first supporting portion and said second supporting portion are closed to hold the substrate.

30. The plating apparatus according to claim 1, wherein said substrate transferring device comprises a robot having a drying hand and a wet hand.

* * * * *